US006975821B2

(12) United States Patent
Suzuki et al.

(10) Patent No.: US 6,975,821 B2
(45) Date of Patent: Dec. 13, 2005

(54) IMAGE FORMING APPARATUS

(75) Inventors: Takashi Suzuki, Nagano (JP); Takumi Sato, Nagano (JP)

(73) Assignee: Seiko Epson Corporation, Tokyo (JP)

( * ) Notice: Subject to any disclaimer, the term of this patent is extended or adjusted under 35 U.S.C. 154(b) by 27 days.

(21) Appl. No.: 10/426,951

(22) Filed: May 1, 2003

(65) Prior Publication Data

US 2003/0235428 A1 Dec. 25, 2003

(30) Foreign Application Priority Data

May 7, 2002 (JP) ..... P2002-131392
Jul. 8, 2002 (JP) ..... P2002-198191
Jul. 12, 2002 (JP) ..... P2002-203493

(51) Int. Cl.[7] ..... G03G 15/00; G03G 21/20
(52) U.S. Cl. ..... 399/107; 399/93; 399/94
(58) Field of Search ..... 399/107, 110, 113, 399/115–116, 118–119, 121–122, 124–125, 399/123, 92–93, 98–100

(56) References Cited

U.S. PATENT DOCUMENTS 4,154,521 A 5/1979 Tanaka
5,341,194 A 8/1994 Haneda et al.
5,631,686 A 5/1997 Castelli et al.
5,840,457 A 11/1998 Urawa et al.
6,249,305 B1 6/2001 Miyamoto et al.
6,292,641 B1 9/2001 Takeyama et al.
6,321,044 B1 11/2001 Tanaka
6,539,194 B2 * 3/2003 Oikawa ..... 399/299

FOREIGN PATENT DOCUMENTS

EP 0 561 544 A2 9/1993
JP 5-82588B2 A 4/1986
JP 2002-244531A A 8/2002

* cited by examiner

*Primary Examiner*—Hoang Ngo
(74) *Attorney, Agent, or Firm*—Sughrue Mion, PLLC

(57) ABSTRACT

At least one developing device applies toner onto a latent image formed on an image supporter to form a toner image thereon. A belt member is stretched and circulated by a plurality of roller members. The toner image, which is to be secondarily transferred onto a recording medium, is primarily transferred onto the belt member. A fixing device heats the recording medium to fix the secondary transferred toner image thereon. A casing accommodates the image supporter, the developing device, the roller members, the belt member and the fixing device, such that the developing device and the fixing device are partitioned by the belt member, and such that one of the roller members is located at a corner portion of the casing.

23 Claims, 19 Drawing Sheets

IMAGE FORMING APPARATUS

BACKGROUND OF THE INVENTION

The present invention relates to an image forming apparatus for forming an image by using an electrophotography technique, such as a printer, a facsimile, a copying machine or the like.

A related-art image forming apparatus is shown in FIG. 19. The apparatus comprises a photoreceptor (image supporting device) 1 having a photosensitive layer on the outer peripheral surface thereof, a charging device 2 for uniformly charging the outer peripheral surface of the photoreceptor 1, an exposing device 3 for selectively exposing the outer peripheral surface uniformly-charged by the charging device 2 to light to form an electrostatic latent image, a developing device 4 for applying toner serving as developer to the electrostatic latent image formed by the exposing device 3 to form a visible image (toner image), and an intermediate transfer belt 5 suspended among plural rollers 5*a* to 5*d* with tension. The toner image formed on the photoreceptor 1 is primarily transferred at a position T1 onto the intermediate transfer belt 5 and further secondarily transferred at a position T2 onto a recording medium. The related-art apparatus further comprises a fixing device 6 for heating and fixing the toner image concerned on the recording medium on which the toner image from the intermediate transfer belt 5 is transferred. These constituent elements are accommodated in a casing as shown in FIG. 19.

In the related-art image forming apparatus described above, all the rollers 5*a* to 5*d* among which the intermediate transfer belt 5 is stretched are disposed in the neighborhood of the center portion in the casing 7.

Therefore, the heat of the fixing device 6 is liable to bypass the intermediate transfer belt 5 and go around to the developing device 4 as indicated by an arrow A, so that the developing device 4 is easily heated.

Heating of the developing device 4 causes toner accommodated in the developing device 4 to be heated, and thus there is a problem that the transfer characteristic of the toner is deteriorated or the toner is liable to cause a blocking phenomenon in the developing device.

In the related-art image forming apparatus described above, the intermediate transfer belt 5 and the exposing device 3 are disposed to be far away from each other. Therefore, the heat of the fixing device 6 is liable to bypass the intermediate transfer belt 5 and go around to the developing device 4 as indicated by an arrow B, so that the developing device 4 is apt to be heated.

Heating of the developing device 4 causes toner accommodated in the developing device 4 to be heated, and thus there is a problem that the transfer characteristic of the toner is deteriorated or the toner is liable to cause blocking in the developing device.

In the related-art image forming apparatus described above, the fixing device 6 comprises an oil coating type fixing device. In FIG. 19, reference numeral 6*a* represents a fixing belt, and reference numeral 6*b* represents an oil coating roller for coating oil to the fixing belt 6*a*.

In such a construction, oil is evaporated from both the surface of the fixing belt 6*a* and the surface of the oil coating roller 6*b* because the fixing device 6 is a heating type fixing device. The oil thus evaporated adheres to the surface of the intermediate transfer belt 5, resulting in occurrence of a problem that transfer failure is liable to occur or cleaning failure (filming) of the intermediate transfer belt 5 is liable to occur. The filming (the phenomenon that toner adheres or fixes in the form of a thin film) on the surface of the intermediate transfer belt 5 is further promoted by heating the toner in the developing device 4.

By the way, an optical sensor is used in such an image forming apparatus. For example, there is used an optical sensor for detecting the density of a toner image formed on the surface of the photoreceptor or the surface of the intermediate transferring member.

The optical sensor does not properly bring out its performance when the light emitting window or light receiving window thereof is soiled. When the image forming apparatus is operated, floating toner occurs inside the apparatus, and if the operating time is long, a large amount of floating toner would adhere to the light emitting window or light receiving window of the optical sensor, so that the performance of the optical sensor is remarkably deteriorated.

Accordingly, the light emitting window or light receiving window of the optical sensor is required to be cleaned before it is considerably soiled with toner.

However, it is not desirable to impose a cleaning work on a user. The imposition of the cleaning work on the user makes the user feel tangled, and it is not always that the cleaning is carried out by the user before the performance of the optical sensor is remarkably deteriorated.

Therefore, there has been proposed a cleaning device for automatically cleaning an optical sensor periodically (for example, at a rate of once per 30 to 40 times of the image forming operation) by moving a cleaner on the detection face of the optical sensor in synchronism with the operation of the image forming apparatus (disclosed in Japanese Patent Publication No. 5-82588B, for example).

However, in such a related-art apparatus, it is necessary to provide a complicated mechanism for moving such a cleaner in synchronism with the operation of the image forming apparatus.

Furthermore, since the optical sensor is automatically cleaned by the cleaner in synchronism with the operation of the image forming apparatus frequently (for example, at a rate of once per 30 to 40 times of the image forming operation), deterioration of the cleaner is promoted and finally no excellent cleaning effect can be achieved.

In a case where a charger (for example, a charger using corona discharging technique) generating ozone is used, and if ozone thus generated stagnates in a casing of the image forming apparatus, the ozone would adversely affect the surface of the image supporter and thus deteriorate an image to be formed.

Besides, when an image on the image supporter is developed by the developing device, toner sometimes scatters in the form of mist at the developing section (mainly at the downstream side in the rotational direction of the developing member which is the downstream side in the rotational direction of the image supporter), and the inside of the apparatus is polluted by the toner. In a case where the developing operation is carried out while switching the plural developing devices (developing colors) by intermittently rotating the rotator body. Therefore, toner is liable to scatter in the switching operation and this toner also pollutes the inside of the apparatus.

As a countermeasure to the ozone and the scattering toner as described above, it may be considered that a toner suction duct for mainly sucking scattering toner is formed at the downstream side of the developing portion with respect to the image supporter in connection with the rotational direction of the developing member, so that ozone as well as scattering toner is sucked by the toner suction duct.

However, it has been found that the following problem occur in such a construction. That is, when images having only a single color (for example, monochromatic images) are sequentially formed, the switching operation of the developing device is not carried out during the image forming operation, and a developing device for a specific color is kept to be in contact with or in close proximity to the image supporter, so that air flow directing from the upstream side to the downstream side in the rotational direction of the developing member is interrupted at the developing portion or extremely reduced.

Therefore, toner scattering to the downstream side in the rotational direction of the developing member is sucked by the toner suction duct, however, ozone stagnates at the upstream side in the rotational direction of the developing member, so that there occurs a problem that the stagnant ozone adversely affects the surface of the image supporter to deteriorate an image to be formed.

SUMMARY OF THE INVENTION

It is therefore an object of the present invention to provide an image forming apparatus in which toner stored in the developing device is hardly heated.

It is also an object of the present invention to provide an image forming apparatus in which toner stored in the developing device is hardly heated.

It is also an object of the invention to provide an image forming apparatus in which oil does not adhere to the intermediate transfer belt.

It is also an object of the present invention to provide a semiautomated cleaning mechanism for an optical sensor in an image forming apparatus in which an optical sensor can be cleaned by a simple mechanism and an excellent cleaning effect can be achieved for a long term.

It is also an object of the present invention to provide an image forming apparatus which can prevent deterioration of images due to ozone and at the same time prevent pollution of the inside of the apparatus by scattering toner.

In order to achieve the above objects, according to the invention, an image forming apparatus, comprising:

an image supporter;

at least one developing device, which applies toner onto a latent image formed on the image supporter to form a toner image thereon;

a plurality of roller members;

a belt member, stretched and circulated by the roller members, on which the toner image, which is to be secondarily transferred onto a recording medium, is primarily transferred;

a fixing device, which heats the recording medium to fix the secondary transferred toner image thereon; and a casing, which accommodates the image supporter, the developing device, the roller members, the belt member and the fixing device, such that the developing device and the fixing device are partitioned by the belt member, and such that one of the roller members is located at a corner portion of the casing.

Accordingly, such a situation that the heat of the fixing device bypasses the belt member and goes around to the developing device can be remarkably reduced, and the developing device is hardly heated.

Therefore, the toner stored in the developing device is also hardly heated, so that the transfer characteristic of the toner is hardly deteriorated and the toner in the developing device hardly causes the blocking phenomenon.

Preferably, the image forming apparatus further comprises: an exposing device, which selectively irradiates the image supporter to form the latent image thereon, the exposing device is located in the vicinity of the belt member; and a cooler, which cools the exposing device. Here, the developing device and the fixing device are partitioned by the belt member and the exposing device.

Although the exposing device itself is a heat source, since the cooler perform cooling of the exposing device, such a situation that the developing device is heated by the exposing device can be prevented. In addition, hot air from the fixing device is also removed by the cooler.

Accordingly, the developing device is prevented from being heated by the hot air that is bypassing the belt member.

Therefore, the toner stored in the developing device is hardly heated, so that the transfer characteristic of the toner is hardly deteriorated and also the toner in the developing device hardly causes the blocking phenomenon.

Preferably, the fixing device is provided as an oil-less fixing device. In this case, the situation that evaporated oil adheres to the surface of the belt member can be avoided.

Accordingly, transfer failure hardly occurs, and cleaning failure of the belt member hardly occurs.

Preferably, the image forming apparatus further comprises:

a cover member, which is opened or closed at least when a consumable member including at least one of the image supporter and the developing device is replaced;

an optical sensor, which detects a density of the toner image formed on either the image supporter or the belt member, the optical sensor comprising a light emitting window and a light receiving window; and a cleaner, which slides on at least one of the light emitting window and the light receiving window interlockingly with an opening/closing movement of the cover member.

In such a configuration, as a result of the opening/closing of the cover member, the optical sensor is semi-automatically cleaned particularly without making the user pay his/her attention to the cleaning operation.

Since the cover member and the cleaner are merely interlocked with each other, so that the mechanism can be simplified.

Since the cleaning operation is carried out at least when the consumable member is replaced, the cleaner is prevented from being excessively deteriorated. As a result, the excellent cleaning effect can be maintained for a long term.

In addition, an initializing operation carried out by a controller of the image forming apparatus just after the consumable member is replaced is carried out on the basis of the detection result of the optical sensor just after the cleaning. Therefore, an effect of performing accurate initialization can be achieved.

Here, it is preferable that at least one of the light emitting window and the light receiving window is covered with the cleaner when the cover member is opened.

According to a type of the consumable member, there is an anxiety that toner scatters in the apparatus when such a consumable member is replaced. For example, when a developer cartridge is replaced, toner adhering to the developing roller and the surrounding parts thereof may scatter.

According to the above configuration, since at least one of the light emitting window and the light receiving window of the optical sensor is covered by the cleaner when the cover is opened to replace a consumable member, even if toner scatters in the apparatus when the consumable member is replaced, the toner is prevented from adhering to the light emitting window and/or light receiving window of the optical sensor.

Accordingly, there can be prevented the situation that the light emitting window and the light receiving window of the optical sensor are soiled with toner when the consumable member is replaced.

Preferably, the image forming apparatus further comprising: a charger, which charges the image supporter; a first duct, which mainly sucks scattered toner; and a second duct, which mainly sucks ozone generated from the charger. The developing device comprises a developing roller forming a developing portion at which the toner is applied to the image supporter. The first duct is located in a downstream side of the developing portion in connection with a rotational direction of the developing roller. The second duct is located in an upstream side of the developing portion in connection with the rotational direction of the developing roller.

In such a configuration, toner scattering to the downstream side in the rotational direction of the developing member is sucked by the first duct, and ozone which is about to stagnate at the upstream side in the rotational direction of the developing member is sucked by the second duct.

Accordingly, the stagnancy of ozone at the upstream side in the rotational direction of the developing member can be prevented and thus image deterioration can be prevented.

Here, it is preferable that the image forming apparatus further comprises a cylindrical rotator, which accompanies the at least one developing device at an outer periphery thereof.

A plurality of developing devices may be provided with the rotator to form a color image. During the switching operation of the developing device to be used, the rotator is rotated so as to form a relatively large clearance between the developing roller and the image supporter. At this time, the ozone is also sucked by the first duct.

Here, it is further preferable at least one of the first duct and the second duct has a semi-cylindrical shape so as to extend along the outer periphery of the cylindrical rotator.

In such a configuration, an air duct can be formed by efficiently using a space around the circumference of the cylindrical rotator. Accordingly, the apparatus can be downsized.

In a case where both of the first duct and the second duct have the above configuration, the space around the circumference of the cylindrical rotator is shared by them substantially half and half. Accordingly, the apparatus can be further downsized.

It is also preferable that at least one of the first duct and the second duct is formed by a part of a frame body of the image forming apparatus.

In such a configuration, with respect to at least one of the ducts, a long member to form the duct concerned is not required, so that the fabrication performance of the apparatus can be enhanced, and the apparatus can be further downsized.

It is also preferable that the first duct comprises a first ventilation fan, and the second duct comprises a second ventilation fan.

In such a configuration, toner suction force caused by the first duct and ozone suction force caused by the second duct can be properly and easily set.

Here, it is preferable that a displacement volume of the second ventilation fan is smaller than a displacement volume of the first ventilation fan.

In such a configuration, no great turbulence occurs in the air flow directing to the first duct when a rotator accompanying a plurality of developing devices is rotated to switch the developing device to be used, and scattering toner can be excellently sucked.

According to the invention, there is also provided an image forming apparatus, comprising:

an image supporter;

at least one developing device, which applies toner onto a latent image formed on the image supporter to form a toner image thereon;

an optical sensor, which detects a density of the toner image formed on either the image supporter or the belt member, the optical sensor comprising a light emitting window and a light receiving window;

a casing, which accommodates the image supporter, the developing device, the optical sensor, the casing comprises a cover member, which is opened or closed at least when a consumable member including at least one of the image supporter and the developing device is replaced; and a cleaner, which slides on at least one of the light emitting window and the light receiving window interlockingly with an opening/closing movement of the cover member.

Here, it is preferable that at least one of the light emitting window and the light receiving window is covered with the cleaner when the cover member is opened.

BRIEF DESCRIPTION OF THE DRAWINGS

The above objects and advantages of the present invention will become more apparent by describing in detail preferred exemplary embodiments thereof with reference to the accompanying drawings, wherein.

DETAILED DESCRIPTION OF THE PREFERRED EMBODIMENTS

Preferred embodiments of the invention will be described hereunder with reference to the accompanying drawings.

Figure 1:
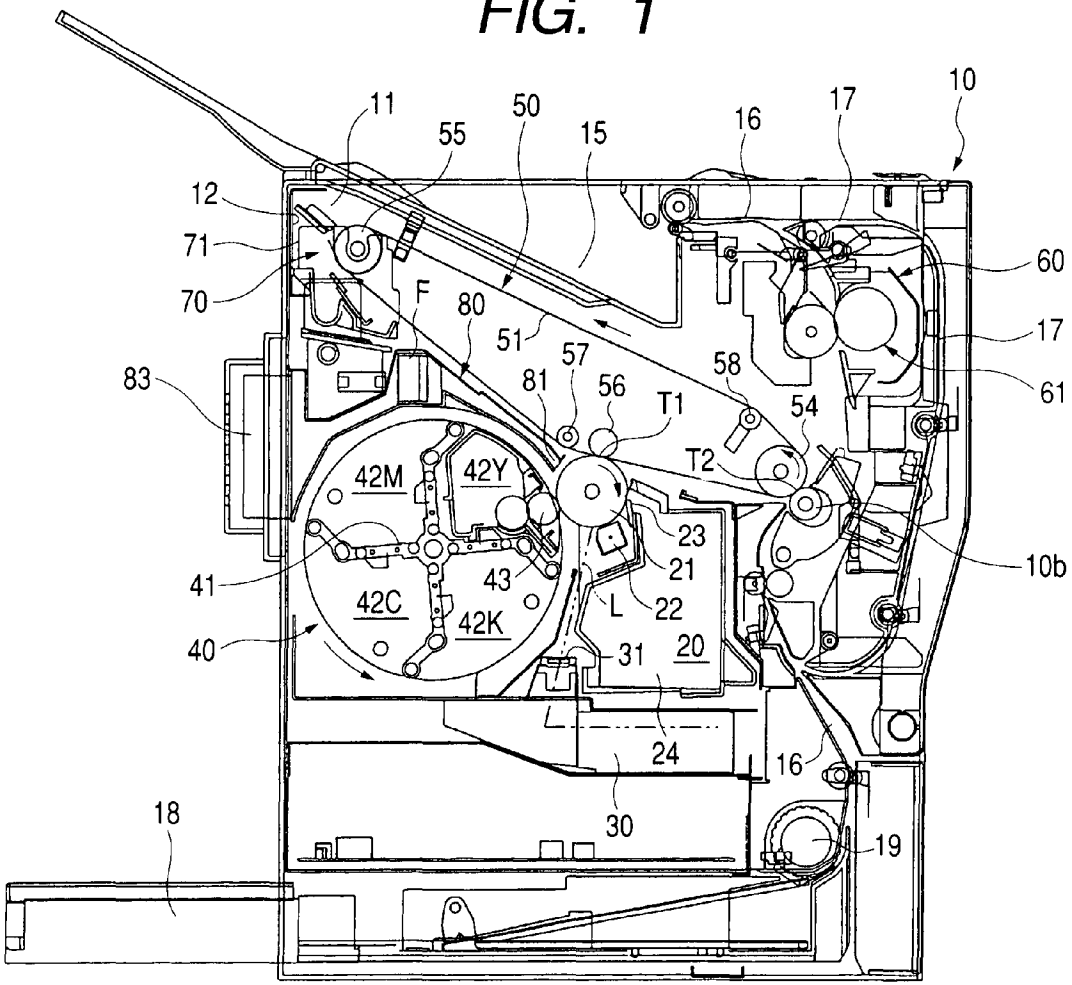
FIG. 1 is a schematic front view showing the internal construction of an image forming apparatus according to a first embodiment of the invention.

FIG. 1 is a schematic front view showing the internal construction of a first embodiment of an image forming apparatus according to this invention.

As shown in FIG. 1, an image forming apparatus according to a first embodiment of the invention is a color image forming apparatus that can form a full color image on both the sides of a sheet (recording medium), and equipped with a casing 10, and an image supporting device 20, an exposing device 30, a developing device 40, an intermediate transferring device 50 and a fixing device 60 which are accommodated in the casing 10.

The casing 10 is equipped with a frame (not shown) of the main body of the apparatus, and the respective devices are secured to the frame.

The image supporting device 20 is equipped with a photoreceptor (image supporter) 21 having a photosensitive layer on the outer peripheral surface thereof, and a charging device (corona charger) 22 for uniformly charging the outer peripheral surface of the photoreceptor 21. The outer peripheral surface of the photoreceptor 21 which has been uniformly charged by the charging device 22 is selectively exposed to a laser beam L from the exposing device 30 to form an electrostatic latent image, and toner serving as developer is applied to the electrostatic latent image in the developing device 40 to form a visible image (toner image). The toner image thus formed is primarily transferred to an intermediate transfer belt 51 of the intermediate transferring device 50 by a primary transfer position T1, and further secondarily transferred onto a sheet serving as a transfer target by a secondary transfer position T2.

The image supporting device 20 is equipped with a cleaner (cleaning blade) 23 for removing toner remaining on the surface of the photoreceptor 21 after the primary transfer, and a waste-toner container 24 for storing waste toner removed by the cleaner 23.

In the casing 10 are disposed a feeding path 16 along which a sheet having an image formed on one side thereof by the secondary transfer position T2 is fed to a sheet discharger (sheet discharging tray) located at the top portion of the casing 10, and a return path 17 along which the sheet fed to the sheet discharger 15 by the feeding path 16 is switched back and returned to the secondary transfer position T2 to form an image on the other surface of the sheet.

At the lower portion of the casing 10 are disposed a sheet supplying tray 18 for holding plural sheets with the sheets being stacked, and a sheet supplying roller 19 for supplying the sheets to the secondary transfer position T2 one by one.

The developing device 40 is a rotary type developing device, and plural developer cartridges in which toner is stored are detachably mounted on a rotator body 41. In this embodiment, a developer cartridges 42Y for yellow, a developer cartridges 42M for magenta, a developer cartridges 42C for cyan and a developer cartridges 42K for black are provided (only the developer cartridges 42Y for yellow is explicitly illustrated in the figure), and the photoreceptor 21 is selectively brought into contact wit the developing roller 43 to selectively develop the surface of the photoreceptor 21 by rotating the rotator body 41 in the direction of an arrow at an angular pitch of 90 degrees.

The exposing device 30 irradiates the photoreceptor 21 with the laser beam L from an exposure window constructed by a glass plate or the like.

The intermediate transferring device 50 is equipped with a unit frame 50*a* (see FIG. 7), a driving roller 54, a follower roller 55, a primary transferring roller 56, a guide roller 57 for stabilizing the state of the belt 51 in the primary transfer position T1 and a tension roller 58, these rollers being rotatably supported by the frame, and the intermediate transfer belt 51 suspended among these rollers with tension. The belt 51 is circulatingly driven in the direction of an arrow as shown in the figure. The primary transfer position T1 is formed between the photoreceptor 21 and the primary transferring roller 56, and the secondary transfer position T2 is formed at the press-fit portion between the driving roller 54 and the secondary transferring roller 10*b* provided to the main body side.

The secondary transferring roller 10*b* can be brought into contact with and separated from the driving roller 54 (thus the intermediate transfer belt 51), and the secondary transfer position T2 is formed when the secondary transferring roller 10*b* is brought into contact with the driving roller 54.

Accordingly, when a color image is formed, toner images of plural colors are superposed on the intermediate transfer belt 51 under the state that the secondary transferring roller 10*b* is separated from the intermediate transfer belt 51, thereby forming a color image. Thereafter, the secondary transferring roller 10*b* is brought into contact with the intermediate transfer belt 51, and a sheet is supplied to the contact portion (secondary transfer position T2) therebetween to transfer the color image (toner image) onto the sheet.

The sheet having the toner image transferred thereon is passed through a heating roller pair 61 of the fixing device 60 to fuse and fix the toner image, and discharged to the sheet discharging tray 15.

The fixing device 60 is constructed by an oil-less fixing device in which the heating roller 61 is coated with no oil.

In the color image forming apparatus as described above, when hot air from the fixing device 60 goes around to the developing device 40 to heat the developer 40, the toner stored in the developing device 40 (in this case, a developer cartridge 42) is heated, so that the transfer characteristic of the toner is deteriorated and the toner is liable to cause the blocking phenomenon in developing device.

Therefore, according to this embodiment, the developing device 40 and the fixing unit 60 are partitioned by the intermediate transfer belt 51, and also one roller 55 of the plural rollers among which the intermediate transfer belt 51 is stretched is located at one corner portion 11 (in this embodiment, at an upper corner portion) in the casing 10.

In such a configuration, the situation that the heat of the fixing device 60 bypasses the intermediate transfer belt 51 and goes around to the developing device 40 can be remarkably reduced, and the developing device 40 is hardly heated.

Therefore, the toner stored in the developing device 40 is hardly heated, so that the transfer characteristic of the toner is deteriorated and the tone hardly causes the blocking phenomenon in the developing device 40.

Since the fixing device 60 is constructed by an oil-less fixing device, no evaporation of oil occurs and thus there is no such situation that the oil adheres to the surface of the intermediate transfer belt 51.

Accordingly, transfer failure hardly occurs, and cleaning failure of the intermediate transfer belt hardly occurs.

In addition, the developing device 40 and the fixing device 60 are partitioned by the intermediate transfer belt 51, so that the developing device 40 is hardly heated by the heat of the fixing device 60 and the toner in the developing device 40 is hardly heated. Therefore, the transfer failure and the cleaning failure of the intermediate transfer belt 51 are surely prevented from occurring.

As a result of the arrangement that the roller 55 is located at the corner portion 11 in the casing 10, the belt length can be increased without causing increase in scale of the apparatus. According to this embodiment, the intermediate transfer belt 51 can form an image of two A4-size sheets (an A3-size sheet) thereon.

Furthermore, the spatial efficiency in the casing 10 can be enhanced and the miniaturization of the apparatus can be more effectively attained by making the inclination angle of the sheet discharging tray 15 substantially coincident with the inclination angle in the longitudinal stretching direction of the intermediate transfer belt 51.

A cleaning device 70 is disposed to confront the roller 55. The cleaning device 70 is used to remove toner remaining on the surface of the intermediate transfer belt 51 after the secondary transfer, and it is disposed so as to extend over the substantially entire width of the belt in the width direction (the direction orthogonal to the surface of the drawing of FIG. 1) of the intermediate transfer belt 51. A casing 71 of the cleaning device 70 is disposed in the vicinity of the inner face 12 of the casing 10 so as to close the gap between the roller 55 (at an end portion around which the belt 51 is wound) and the inner face 12 of the casing 10.

Since the cleaning device 70 is disposed to confront the roller 55, and the casing 71 thereof is disposed in the vicinity of the inner face 12 of the casing 10 so as to close the gap between the roller 55 and the inner face 12 of the casing 10. Therefore, the situation that the heat of the fixing device 60 bypasses the intermediate transfer belt 51 and goes around to the developing device 40 can be surely reduced.

Reference numeral 80 represents a toner suction duct, and a toner suction port 81 is formed at the leading end portion of the toner suction duct 80.

The toner suction duct 80 is equipped in a curved shape (substantially semi-cylindrical shape) so as to cover the upper portion of the rotary developing device 40 about a half around.

Figure 2:
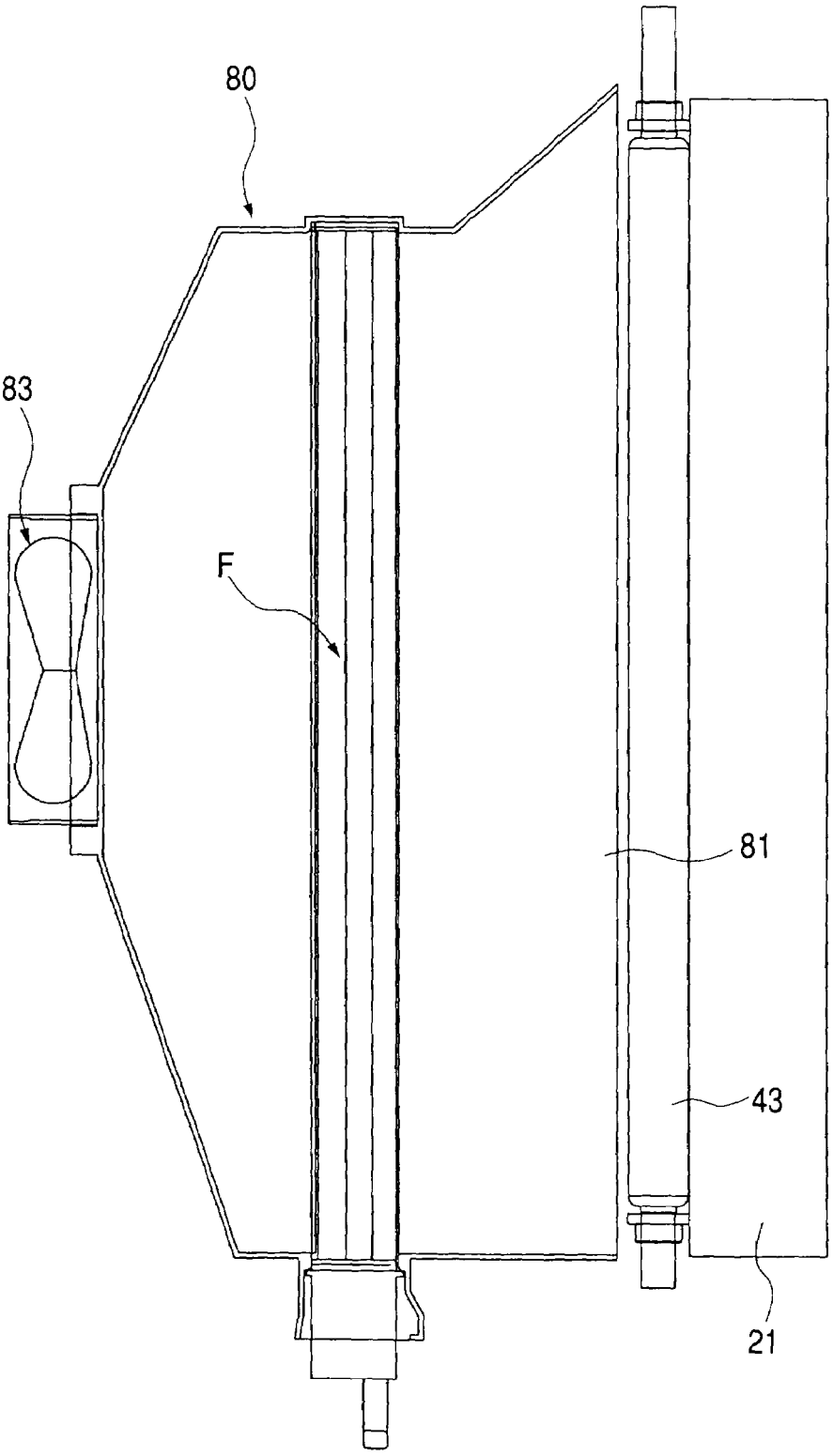
FIG. 2 is an enlarged plan cross-sectional view showing a toner suction duct mainly.

FIG. 2 is an enlarged plan and cross-sectional view showing the toner suction duct 80 mainly.

A ventilation fan 83 is equipped to the terminal portion of the toner suction duct 80, and scattering toner from the suction port 81 and ozone from the charger 22 are respectively sucked by actuating the ventilation fan 83.

That is, even when toner scatters in the form of mist during the developing process of an image on the image supporting device 21 by the developing device 40, the toner is sucked from the toner suction port 81. Likewise, even when toner scatters during the developing color switching operation of the rotary developing device 40, the toner is sucked from the toner suction port 81. Furthermore, the hot air is also discharged by the duct 80.

A filter unit F is detachably equipped at the intermediate portion of the toner suction duct 80 with respect to the front face of the image forming apparatus. The ozone and toner sucked from the suction port 81 are filtered by the filter unit F and clean air is discharged to the outside of the apparatus by the ventilation fan 83.

Since the toner suction duct 80 is equipped in a curved shape (substantially in the semi-cylindrical shape) so as to cover the upper portion of the developing device 40 about a half around, the hot air from the fixing device 60 is further prevented from transferring to the developing device 40. In addition, the hot air is exhausted by the duct 80, so that the heat of the developing device 40 is further surely prevented.

Figure 3:
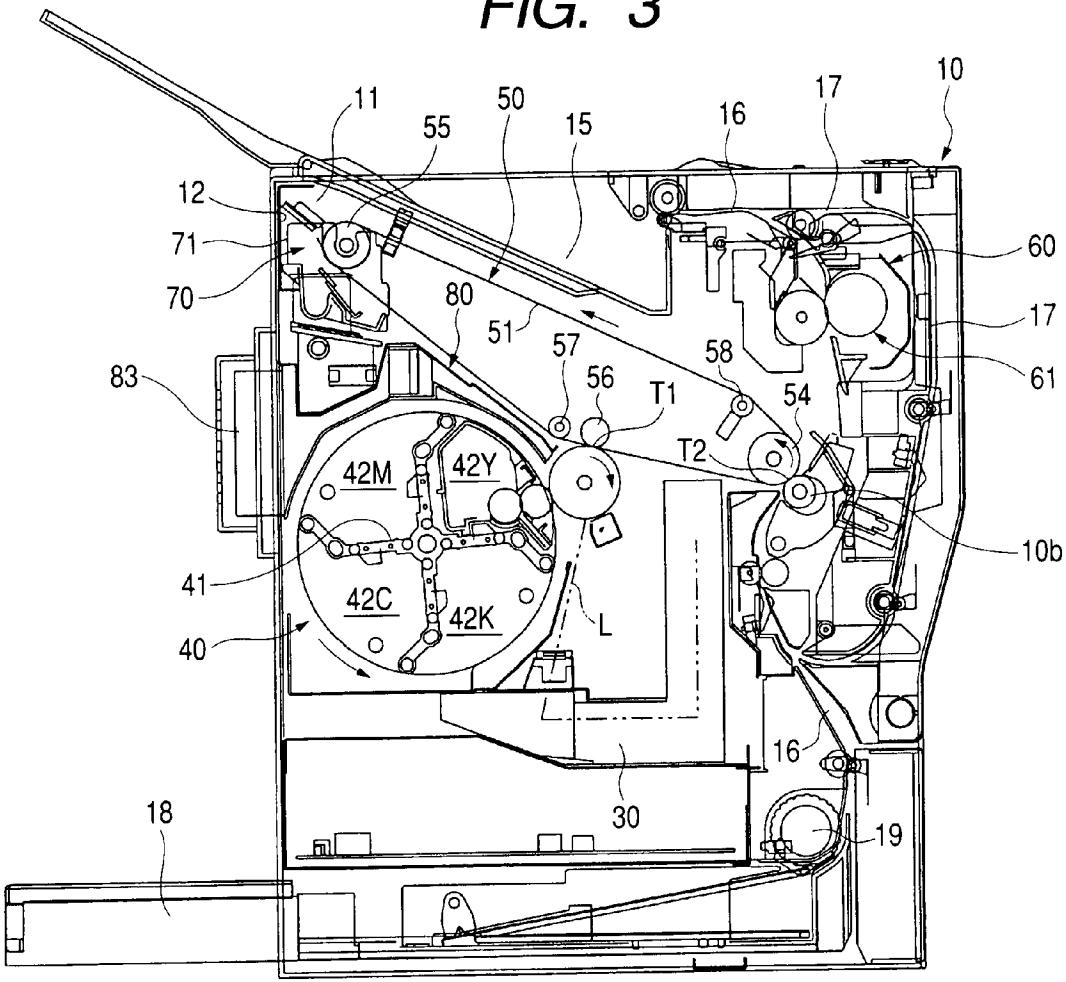
FIG. 3 is a schematic front view showing the internal construction of the image forming apparatus according to a second embodiment of the invention.
Figure 4:
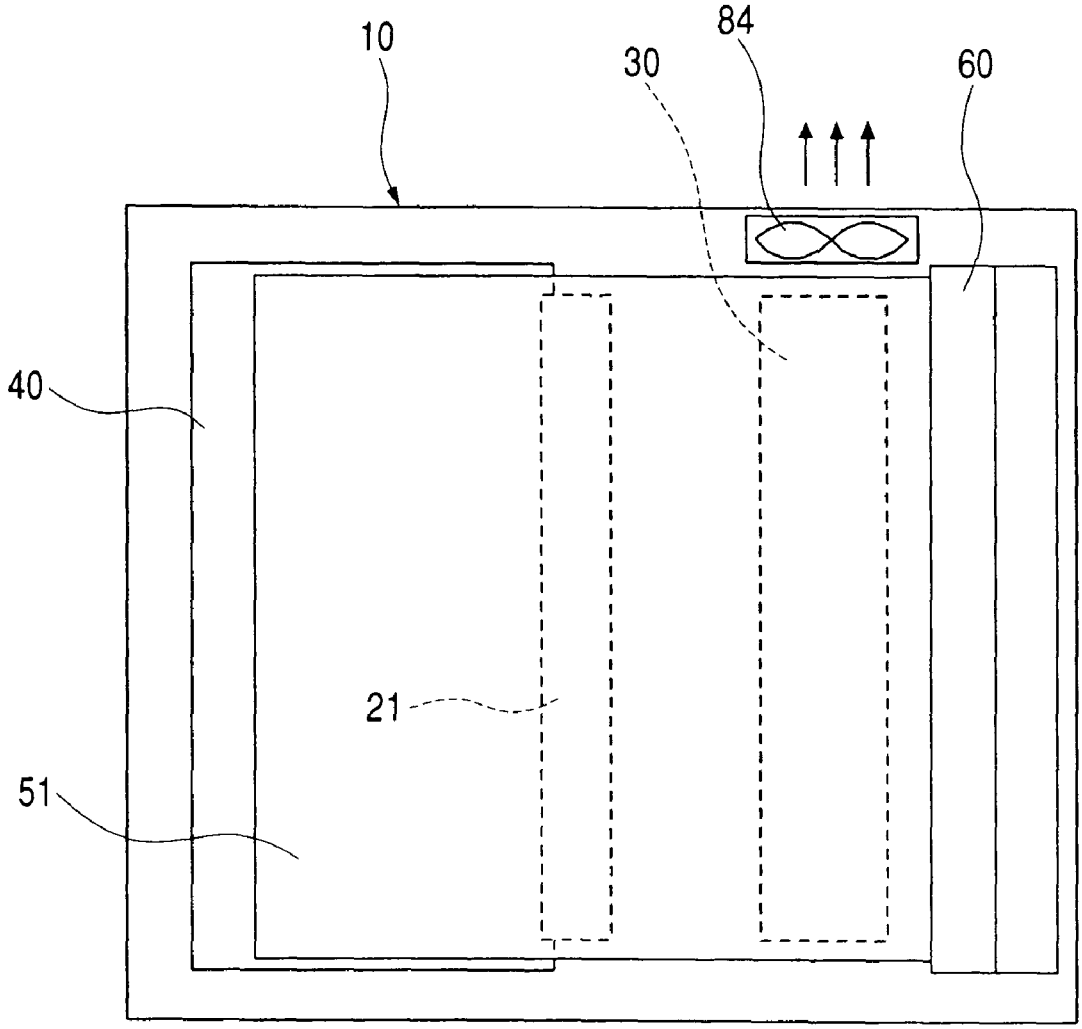
FIG. 4 is a schematic plan view of the image forming apparatus of the second embodiment.

FIGS. 3 and 4 show an image forming apparatus according to a second embodiment of the invention. In these figures, the same portions as or corresponding portions to those of the first embodiment are represented by the same reference numerals.

This embodiment is mainly different from the first embodiment in that the developing device 40 and the fixing device 60 are partitioned by the intermediate transfer belt 51 and an exposing device 30 disposed in the vicinity of the intermediate transfer belt 51, and also the exposing device 30 is equipped with a ventilation fan 84 for cooling the exposing device 30.

The photoreceptor 21 is designed to have a cleaner-less structure which is not equipped with a cleaner (cleaning blade).

According to this embodiment, the following advantages can be attained in addition to the advantages described in connection with the first embodiment.

Since the developing device 40 and the fixing device 60 are partitioned by the intermediate transfer belt 51 and the exposing device 30 disposed in the vicinity of the intermediate transfer belt 51, so that the developing device 40 and the fixing device 60 are kept to be excellently partitioned by the intermediate transfer belt 51 and the exposing device 30. The hot air passing through a passage B is intercepted by the exposing device 30.

The exposing device 30 itself acts as a heat source, however, the situation that the developing device 40 is heated by the exposing device 30 is prevented because the exposing device 30 is equipped with the ventilation fan 84 for cooling the exposing device 30.

In addition, the heat generated from the fixing device 60 is also removed by the ventilation fan 84.

Accordingly, the situation that the developing device 40 is heated by the hot air bypassing the intermediate transfer belt 51 can be surely prevented. As a result, the toner transferring characteristic can be excellently maintained, and the blocking phenomenon of the toner in the developing device 40 can be further reduced.

A third embodiment of the invention will be described with reference to FIGS. 5A through 10. The same reference numerals are assigned to components similar to those in the above embodiments, and detailed explanations for those will be omitted.

Figure 5A:
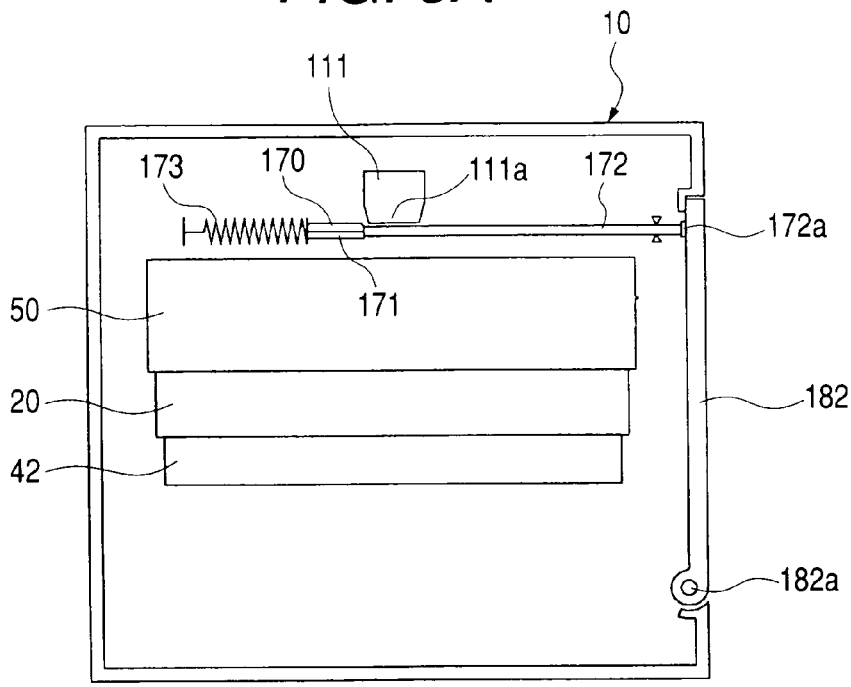
FIG. 5A is a diagram of a schematic construction of an image forming apparatus according to a third embodiment of the invention, showing a state that cover is closed.
Figure 5B:
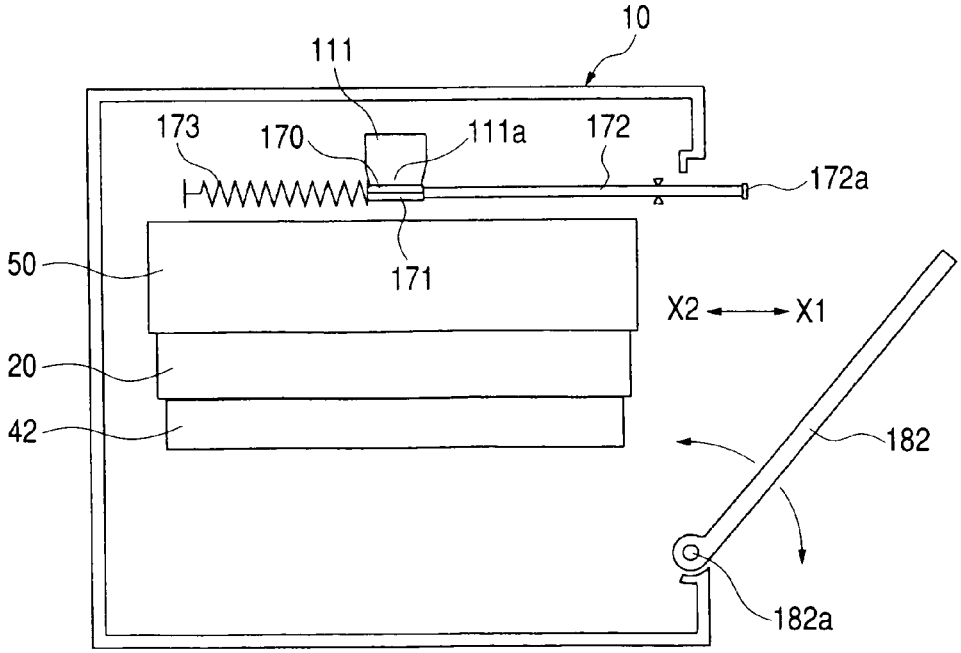
FIG. 5B is a diagram of a schematic construction of the image forming apparatus of the third embodiment, showing a state that the cover is opened.

In this embodiment, at least one of the image supporting device 20, the developing device 42 and the transferring device 50 is constructed as a consumable member. When the life time thereof is expired, a cover 182 shown in FIG. 5A is opened and the consumable member to be replaced is pulled out in the direction of an arrow X1 and a new consumable member is inserted in the direction of an arrow X2 as shown in FIG. 5B. The cover 182 is designed so as to be opened/closed by a shaft 182*a*.

Figure 6:
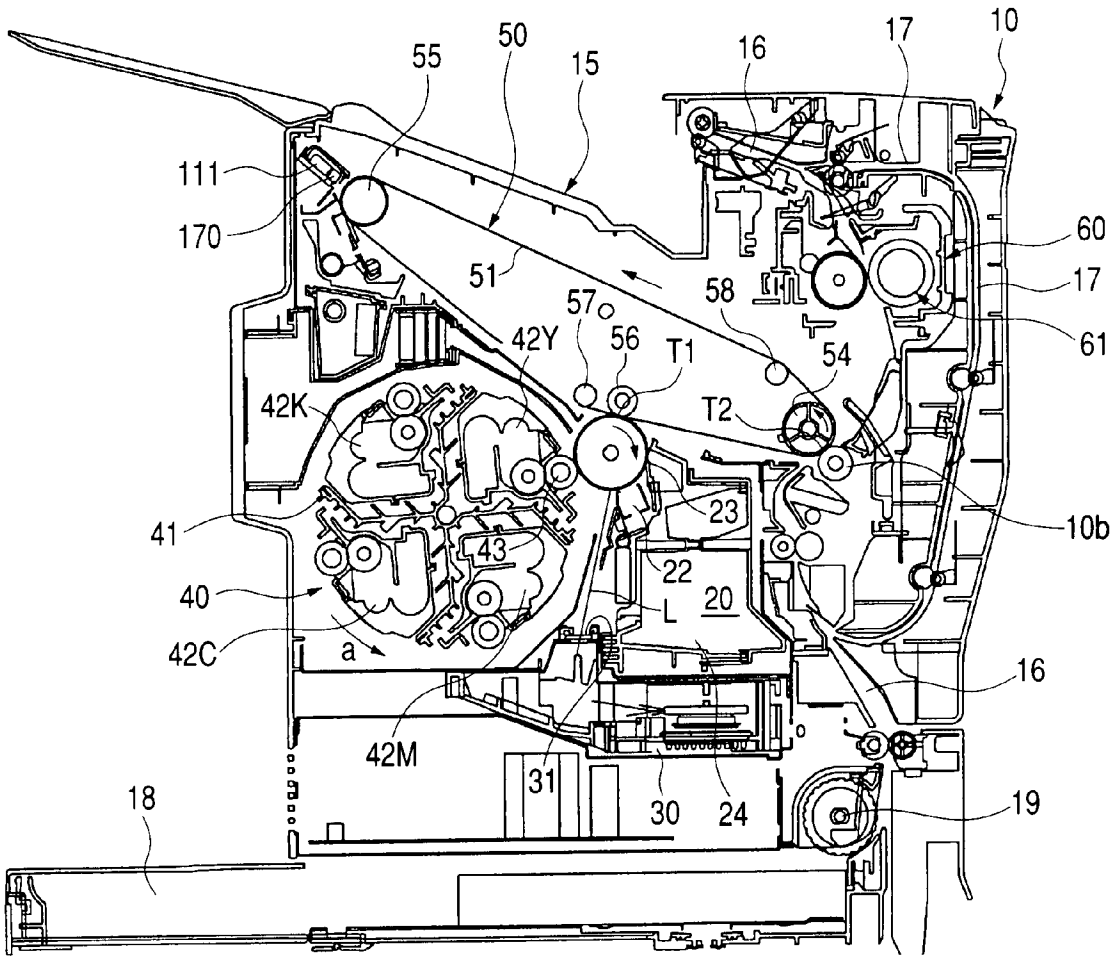
FIG. 6 is a schematic side view showing the internal construction of the image forming apparatus of the third embodiment.

An optical sensor 111 (reflection type) is equipped in the main body of the apparatus in order to detect the density of the toner image transferred onto the intermediate transfer belt 51 in the transferring device 50 (see FIG. 6). A detection signal achieved by the optical sensor 111 is fed back to a controller (not shown) to enhance the image quality.

A cleaner 170 made of, for example, urethane foam is fixed to a holder 171 for cleaning the light emitting window (also serving as the light receiving window) 111*a* of the optical sensor 111 by sliding thereon and rubbing against the light emitting window (the light receiving window) 111*a*.

A rod 172 is fixedly joined to one side (the right side in the figure) of the holder 171, and a tip end 172*a* of the rod 172 is disposed on the pivoting course of the cover 182.

A spring 173 (in this case, compression spring) is equipped between the other side of the holder 171 and the casing 10 of the apparatus, and the holder 171 (thus the cleaner 170 an the rod 172) is always urged in the direction of the arrow X1 in the figure by the action of the spring 173. Under the state that the cover 182 is closed as shown in FIG. 5A, the holder 171 is retracted backward in the direction of the arrow X2 and the cleaner 170 is also retracted backward from the light emitting/receiving window 111*a* of the optical sensor 111 in the direction of the arrow X2, so that the optical sensor 111 is allowed to detect the toner density on the intermediate transfer belt 51.

On the other hand, when the cover 182 is opened as shown in FIG. 5B by a user, the holder 171 (thus the cleaner 170 and the rod 172) is slid in the direction of the arrow X1 in the figure by the urging force of the spring 173, and the cleaner 170 covers the light emitting/receiving window 111*a* of the optical sensor 111 while sliding on and rubbing against the light emitting/receiving window 111*a* to thereby clean the light emitting/receiving window 111*a*. Furthermore, the tip end 172*a* of the rod 172 is projected outward.

When the user closes the cover 182 after a consumable member is replaced, the tip end 172*a* of the rod 172 abuts against the cover 182 as shown in FIG. 5A from the state shown in FIG. 5B, the rod 172 (thus the holder 171 and the cleaner 170) is slid in the direction of the arrow X2, and the cleaner 170 is backward retracted to a position at which the optical sensor 111 can detect the toner density on the intermediate transfer medium while sliding on and rubbing against the light emitting/receiving window 111*a* of the optical sensor 111 again to thereby clean the light emitting/receiving window 111*a*.

As occasion demands, the light emitting/receiving window 111*a* of the optical sensor 111 may be manually cleaned by pressing the tip end 172*a* of the rod 172 under the state that the cover 182 is opened.

In such a configuration, when the cover 182 is opened/closed by the user to replace the consumable member, the cleaner 170 slides on and rubs against the light emitting/receiving window 111*a* of the optical sensor 111, so that the cleaning of the optical sensor 111 is performed.

Accordingly, the opening/closing of the cover results in semiautomated cleaning of the optical sensor 111 without making the user paying attention to the cleaning operation.

According to this mechanism, the cover 182 and the cleaner 170 are merely interlocked with each other, and thus the mechanism can be constructed by a simple mechanism (in the above embodiment, the mechanism constructed by the rod 172 and the spring 173).

Furthermore, since the cleaning operation is carried out only when a consumable member is replaced, the cleaner 170 is prevented from being excessively deteriorated, so that an excellent cleaning effect can be achieved for a long term.

In addition, the initializing operation carried out by the controller of the image forming apparatus just after the consumable member is replaced is carried out on the basis of the detection result of the optical sensor 111 just after the cleaning, so that there can be achieved an effect that accurate initialization can be performed.

When the cover 182 is opened, the light emitting/receiving window 111*a* of the optical sensor 111 are covered by the cleaner 170. Therefore, the following advantages can be obtained.

That is, in the case of some types of consumable members, there is a risk that toner scatters in the casing 10 when each consumable member is replaced. For example, when the developing device 40 (e.g., at least one of the developer cartridges 42C, 42M, 42Y and 42K; see FIG. 6) is replaced, toner adhering to the developing roller 43 and the surrounding parts thereof may scatter.

On the other hand, according to the cleaning mechanism, when the cover 182 is opened to replace a consumable member, the light emitting/receiving window 111*a* of the optical sensor 111 is covered by the cleaner 170. Therefore, even if toner scatters in the casing 10 when a consumable member is replaced, the toner is prevented from adhering to the light emitting/receiving window 111*a* of the optical sensor 111.

Accordingly, there can be prevented the situation that the light emitting/receiving window 111*a* of the optical sensor 111 is soiled with toner when a consumable member is replaced.

Figure 7:
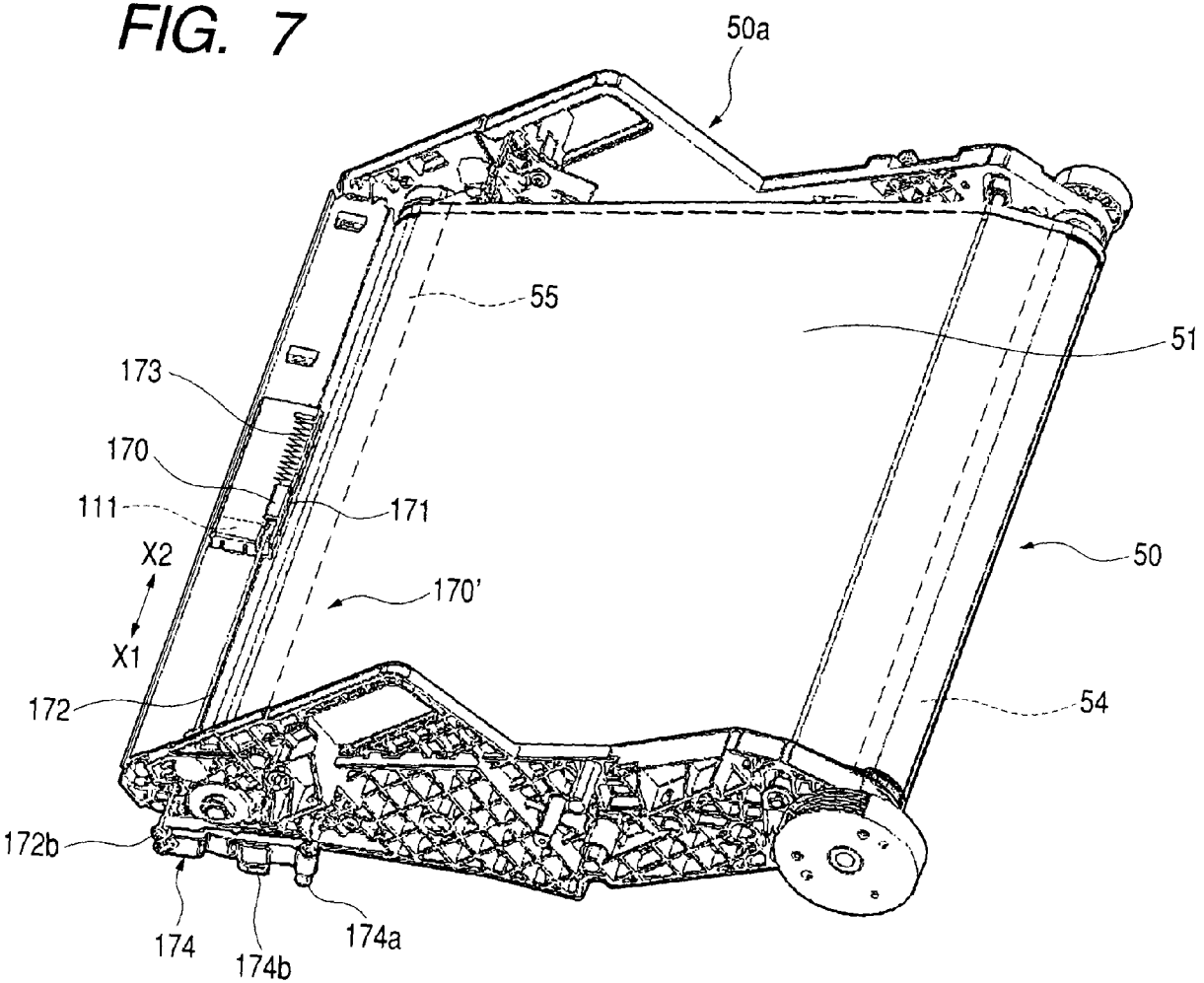
FIG. 7 is a perspective view showing an intermediate transferring device in the image forming apparatus of the third embodiment.

As shown in FIG. 7, the cleaner 170 and an interlocking mechanism 170' which interlocks with the cover 182 are installed in the intermediate transferring device 50. Accordingly, the spring 173 is equipped between the holder 171 and the unit frame 50*a*.

Figure 8:
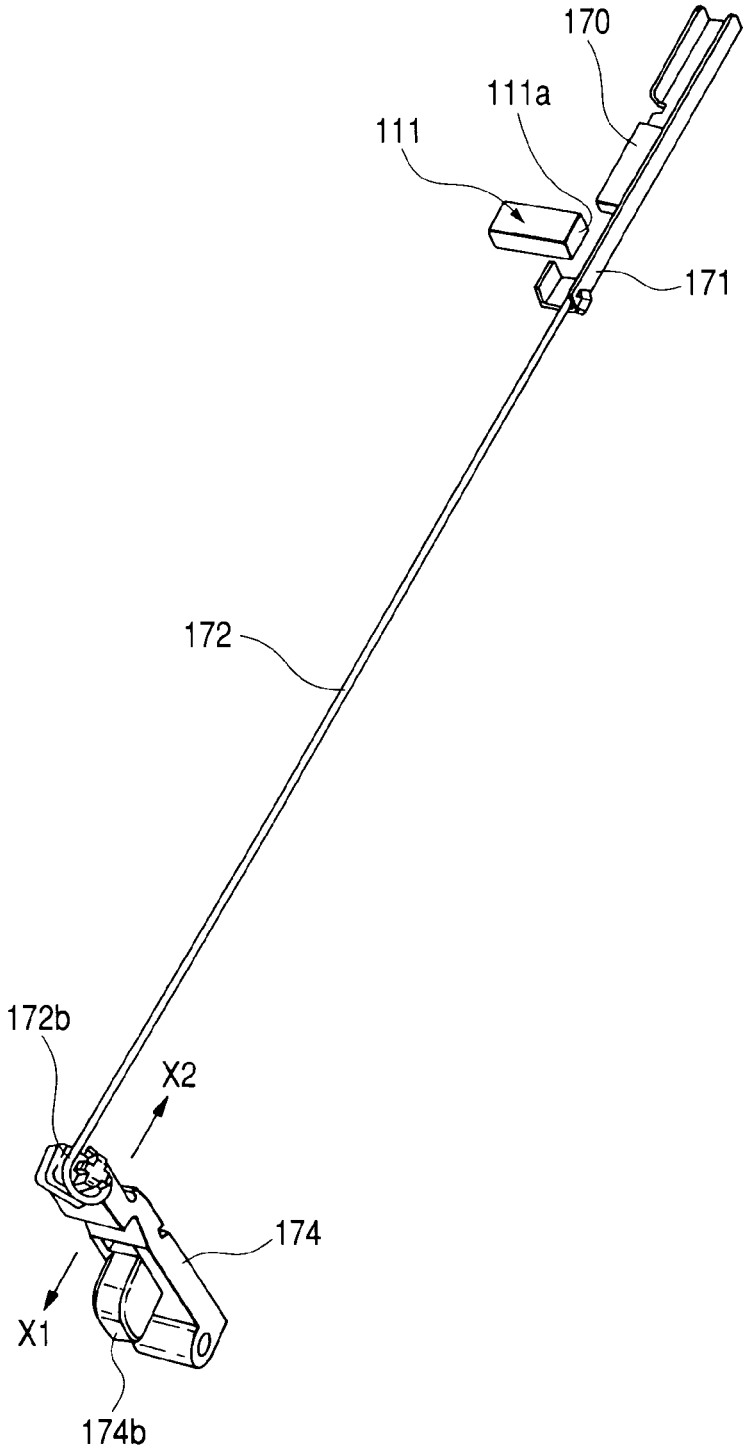
FIG. 8 is a perspective view showing a semiautomated cleaning mechanism for an optical sensor in the image forming apparatus of the third embodiment.

As shown in FIG. 8, the tip end 172*b* of the rod 172 is linked to a lever 174. The lever 174 is pivotably secured to the unit frame 50*a* through a shaft 174*a* (see FIG. 7).

Figure 9:
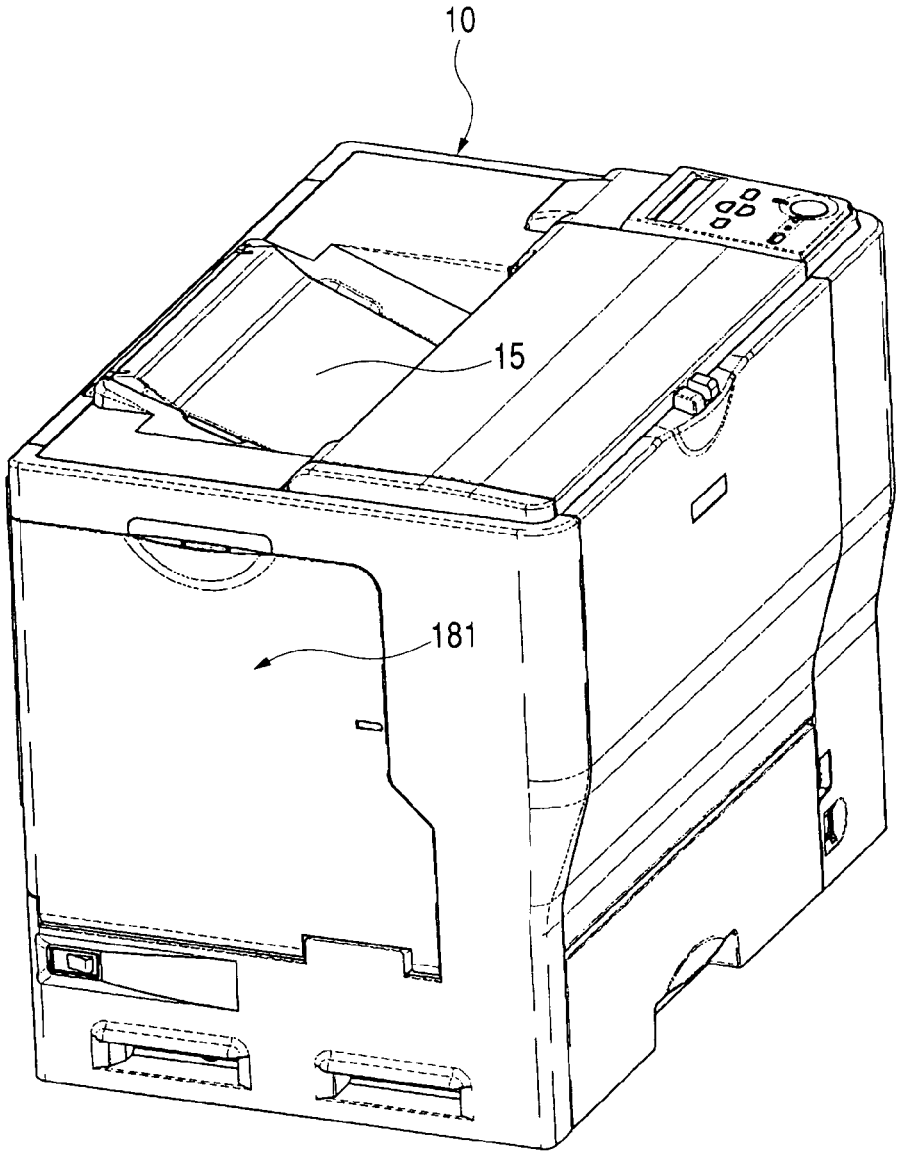
FIG. 9 is a perspective view showing the outlook of the image forming apparatus of the third embodiment when the cover is closed.
Figure 10:
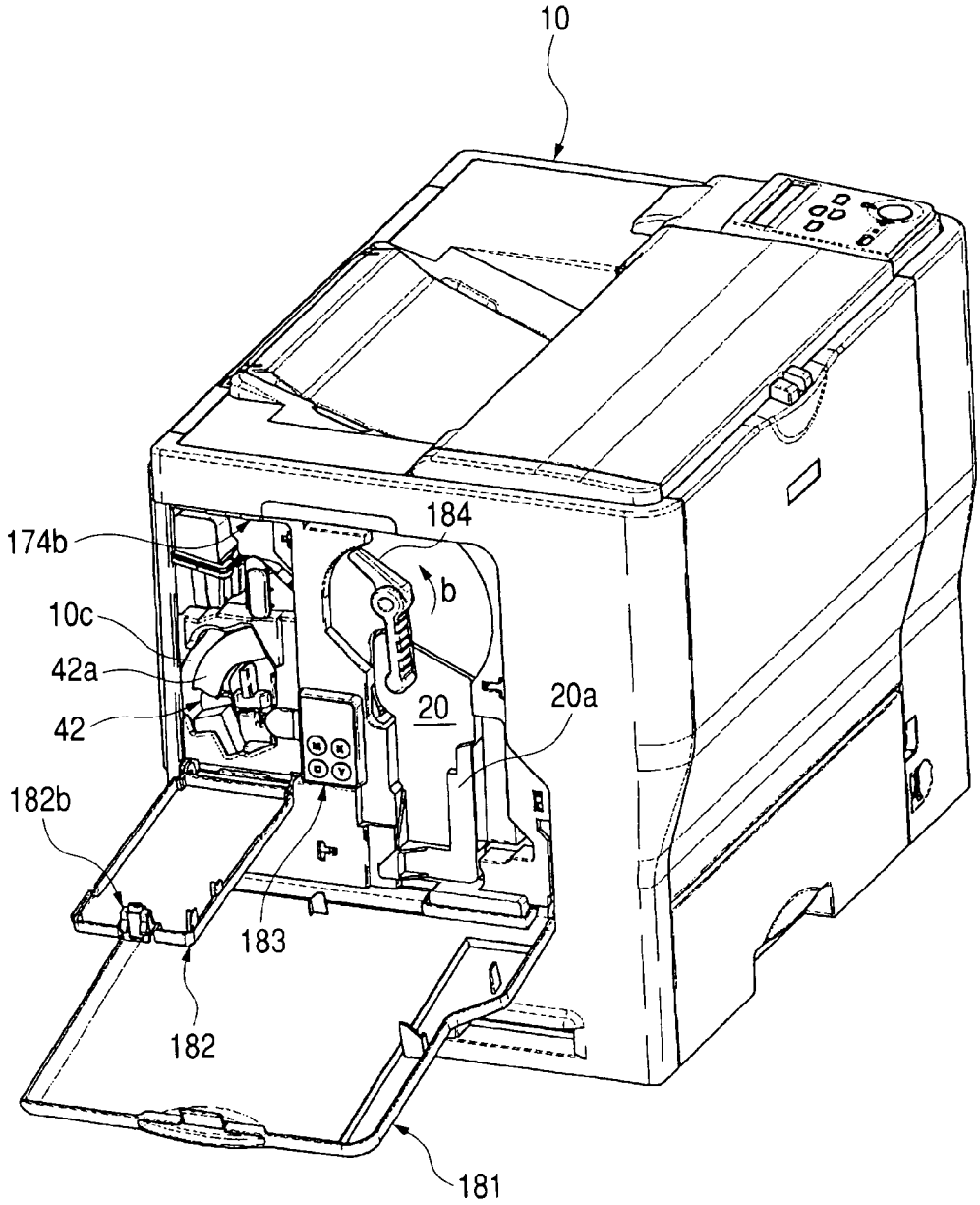
FIG. 10 is a perspective view showing the outlook of the image forming apparatus of the third embodiment when the cover is opened.

FIGS. 9 and 10 are perspective views showing the outlook of the image forming apparatus.

As shown in these figures, in the casing 10 of the apparatus are equipped a cover 181 opened/closed when the image supporting device 20 is replaced, the cover 182 appearing when the cover 181 is opened to replace the developer cartridges 42 (42C, 42M, 42Y and 42K), and a replaced cartridge selector 183 appearing when the cover 181 is opened.

When the cover 181 is opened, the near side of the image supporting device 20 is exposed to the outside as shown in FIG. 10. Therefore, the image supporting device 20 is pulled out or inserted while griping a handgrip 20*a*, whereby the image supporting device 20 to be replaced. The image supporting device 20 is replaced under the state that the lock is released by rotating a lock lever 184 in the direction of an arrow b.

When the cover 182 is opened under the state that the cover 181 is opened, the near side of the developer cartridge 42 are exposed to the outside through an aperture 10*c* formed with the casing 10. Therefore, the developer cartridge 42 can be pulled out from or inserted into the rotator body 41 of the developing device 40 by griping a handgrip 42*a*.

The replaced cartridge selector 183 is used to select a developer cartridge 42 (any one of 42Y, 42M, 42C and 42K) to be replaced. The selector 183 is provided with a switch button Y for selecting the yellow developer cartridge 42Y, a switch button M for selecting the magenta developer cartridge 42M, a switch button C for selecting the cyan developer cartridge 42C and a switch button K for selecting the black developer cartridge 42K.

When the switch button Y is pushed under the state that the developer cartridge cover 182 is closed, the rotator body 41 is rotated and only the yellow developer cartridge 42Y faces the aperture 10*c*. When the switch button M is pushed, only the magenta developer cartridge 42M likewise faces the aperture 10*c*. Furthermore, when the switch button C is pushed, only the cyan developer cartridge 42C likewise faces the aperture 10*c*, and when the switch button K is pushed, the black developer cartridge 42K faces the aperture 10*c*.

Accordingly, when the developer cartridge 42 is actually replaced, the cover 181 is first opened, and the switch for a color to be replaced (any one of Y, M, C, K) is pushed under the state that the developer cartridge cover 182 is closed. Thereafter, the developer cartridge cover 182 is opened, and the developer cartridge 42 for the color concerned is replaced.

The developer cartridge 42 stores such an amount of toner that images can be formed on sheets of about several tens of thousands in a normal image forming mode.

As shown in FIG. 10, a protrusion 174*b* (see also FIG. 8) of the lever 174 appears when the cover 182 is opened.

A protrusion 182*b* is equipped on the inner face of the cover 182. When the cover 182 is closed, the protrusion 182*b* abuts against the protrusion 174*b* to rotate the lever 174 in the direction of X2.

Accordingly, when the cover 182 is closed as shown in FIG. 5A, the rod 172, the holder 171 and the cleaner 170 are slid in the direction of the arrow X2 in FIGS. 7 and 8, and backward retracted to a position at which the optical sensor 111 can detect the toner density on the intermediate transfer belt 51 while the cleaner 170 slides on and rubs against the light emitting/receiving window 111*a* of the optical sensor 111 to perform cleaning.

The protrusion 182*b* of the cover 182 also serves as a locking member when the cover 182 is closed.

When the cover 182 is opened by the user as shown in FIG. 5B to replace the developer cartridge 42, the holder 171 (thus the cleaner 170, the rod 172 and the lever 174) is slid in the direction of the arrow X1 by the urging force of the spring 173 in FIGS. 7 and 8, and the light emitting/receiving window 111*a* of the optical sensor 111 are covered by the cleaner 170 while the cleaner 170 cleans the optical sensor 111 by sliding on and rubbing against the light emitting/receiving window 111*a*. In addition, the lever 174 is rotated in the direction of the arrow X1 so that the protrusion 174*b* projects to the opening.

When the cover 182 is closed by the user after a consumable member is replaced, the protrusion 174*b* of the lever 174 abuts against the protrusion 182*b* of the cover 182 as described above, so that the lever 174 (thus, the rod 172, the holder 171 and the cleaner 170) is slid in the direction of the arrow X2, thereby the cleaner 170 is backward retracted to the position where the optical sensor 111 can detect the toner density on the intermediate transfer belt 51 (see FIG. 8), while the cleaner 170 cleans the optical sensor 111 by sliding on and rubbing against the light emitting/receiving window 111*a* again.

In this embodiment, the reflection type optical sensor 111 is used, and thus the cleaner 170 is designed to slide on and rub against the light emitting/receiving window 111*a* of the optical sensor 111. However, when the optical sensor (not limited to a toner density detecting sensor) is a transparent type sensor, the cleaner may be designed to slide on and rub against one of the light emitting window and the light receiving window (one which is more liable to be soiled with toner).

A fourth embodiment of the invention will be described with reference to FIGS. 11 through 18. The same reference numerals are assigned to components similar to those in the above embodiments, and detailed explanations for those will be omitted.

Figure 11:
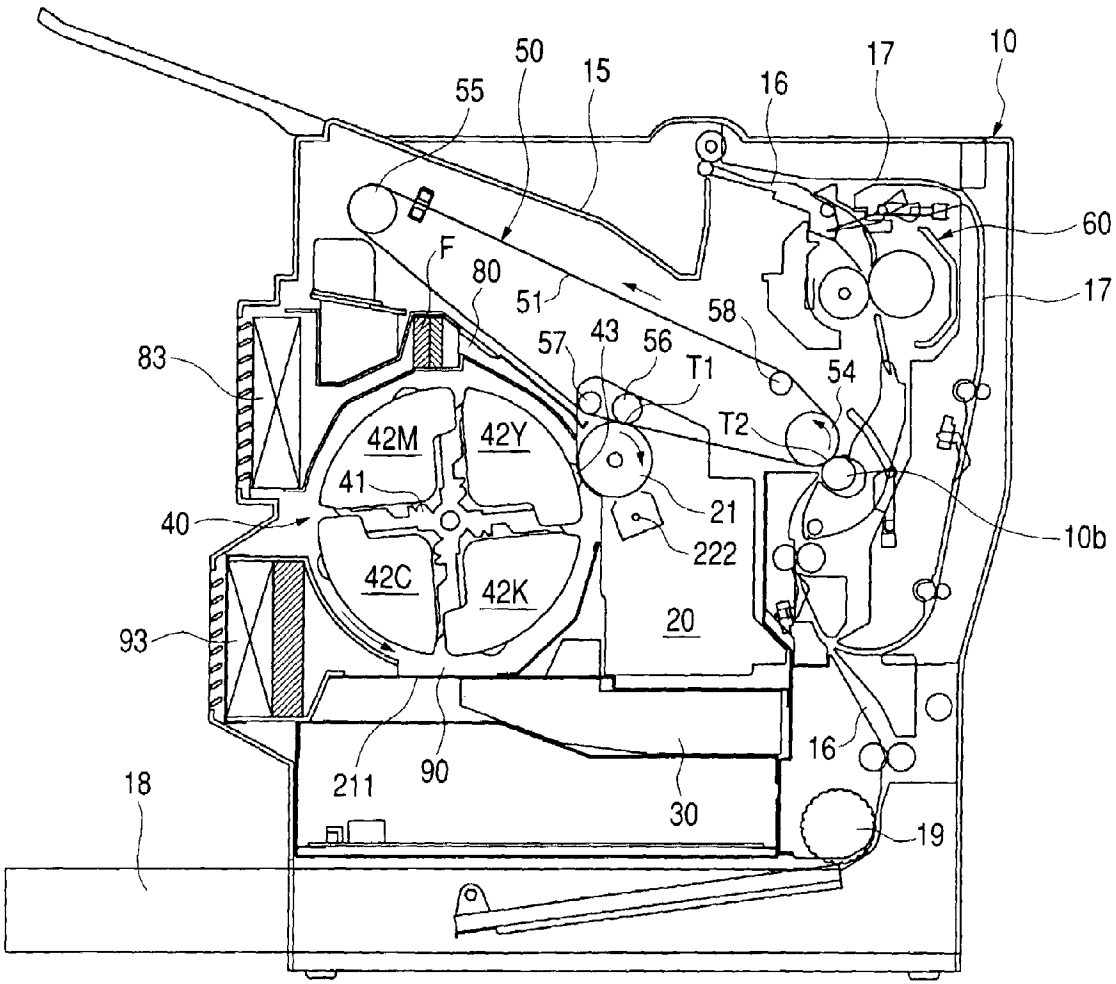
FIG. 11 is a schematic front view showing the internal construction of an image forming apparatus according to a fourth embodiment of the present invention.

In this embodiment, a charger using corona discharging technique (hereinafter, simply referred as a corona charger) 222 is provided in the image supporting device 20 as shown in FIG. 11.

Furthermore, around the circumference of the rotary developing device 40, a toner suction duct 80 for mainly sucking scattering toner is formed at the downstream side of the developing portion D for the image supporter 21 in connection with the rotational direction (counterclockwise direction in FIG. 12) of the developing member 43. On the other hand, an ozone suction duct 90 for mainly sucking ozone is formed at the upstream side of the developing portion D.

Figure 13:
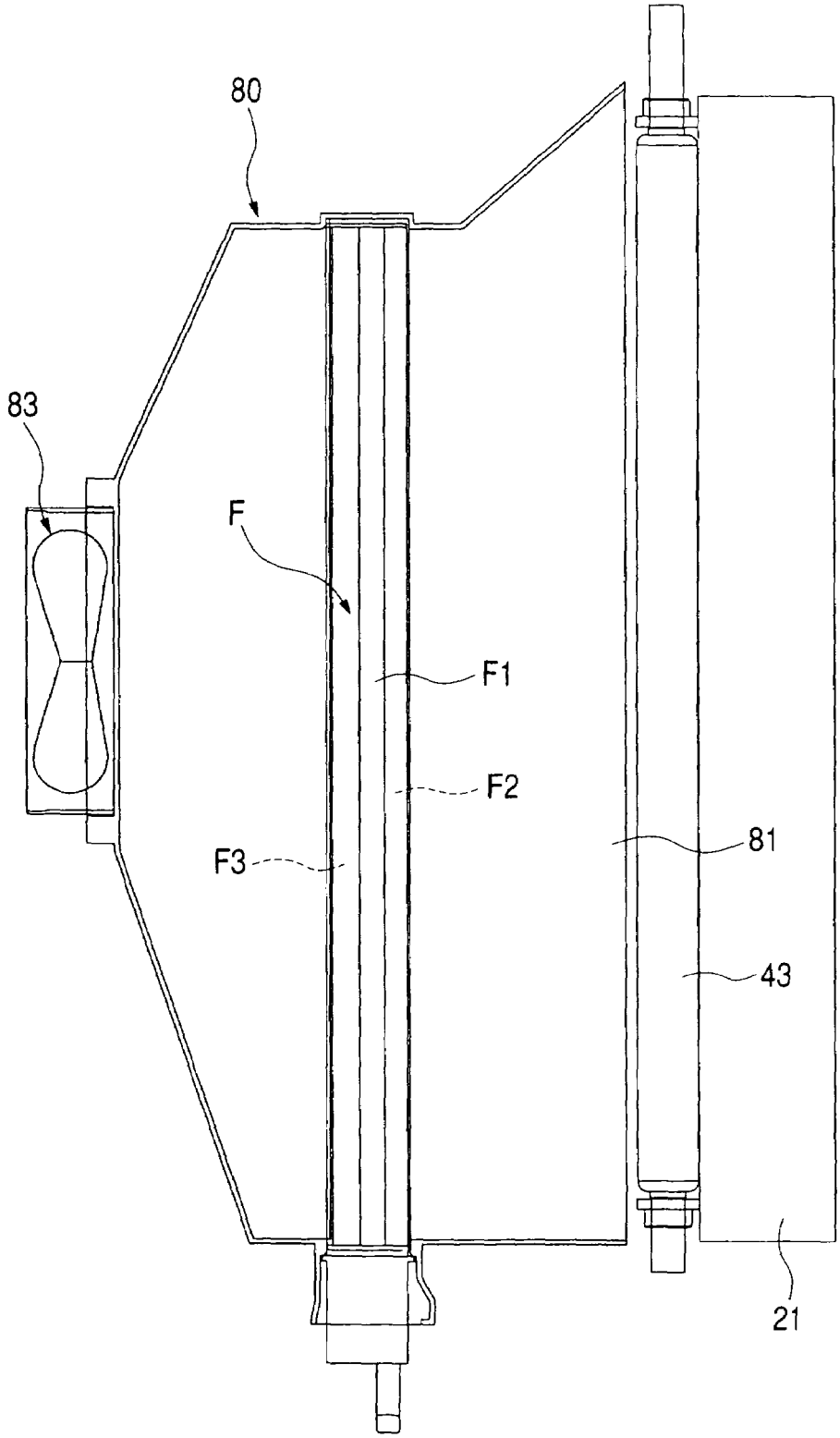
FIG. 13 is a plan sectional view mainly showing a toner suction duct.

As shown in FIG. 13, is a plan and cross-sectional view that mainly shows the toner suction duct 80.

A ventilation fan (first ventilation fan) 83 is equipped to the terminal end portion (vent portion) of the toner suction duct 80. Scattering toner is mainly sucked from a suction port 81 by actuation of the ventilation fan 83, however, ozone is also sucked therefrom as described later.

Figure 12:
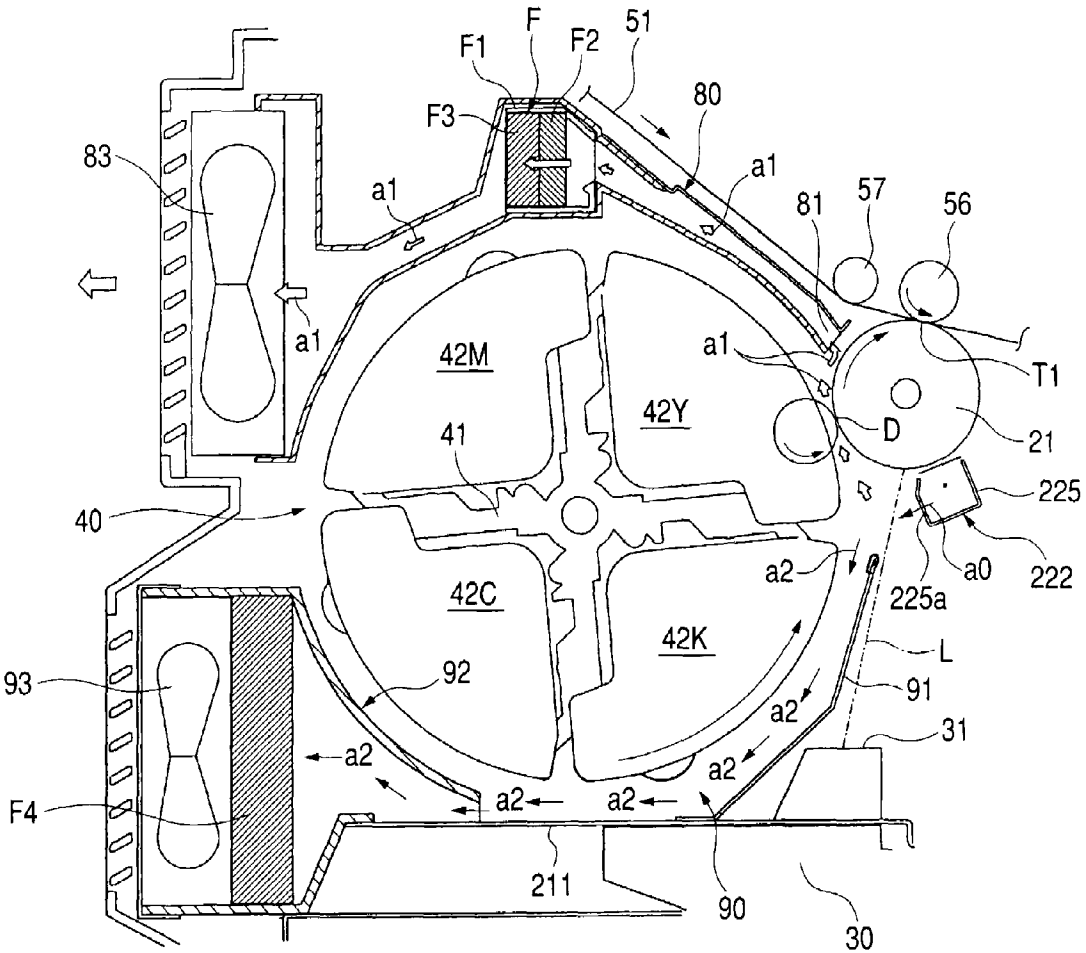
FIG. 12 is an enlarged view showing an essential part of FIG. 11.

As shown in FIGS. 12 and 13, a filter unit F is detachably equipped to the intermediate portion of the toner suction duct 80 so that the filter unit F can be pulled out and inserted through the front face of the image forming apparatus. The filter unit F is equipped with a unit case F1, and a toner filter F2 and an ozone filter F3 which are installed in the unit case F1. Accordingly, ozone and toner sucked from the suction port 81 are filtered by the filter unit F, and clean air is discharged to the outside of the apparatus by the ventilation fan 83.

The ozone suction duct 90 is formed in a substantially semi-cylindrical shape along the circumference of the rotary developing device 40 at the upstream side of the developing portion D for the image supporter 21.

The ozone suction duct 90 is constructed by: a shield plate 91 for shielding toner falling from the developing portion D to the light irradiation window 31 through which the laser beam L is irradiated from the exposing device 30 to the image supporter 21; a frame 211 to which the shield plate 91 is secured; and a short duct 92 secured to the frame 211.

A ventilation fan (second ventilation fan) 93 is equipped to the terminal end portion (vent portion) of the duct 92. Ozone is mainly sucked through the ozone suction duct 90 by actuation of the ventilation fan 93, however, floating toner is somewhat sucked.

As shown in FIG. 12, an ozone filter F4 is equipped to the intermediate portion of the duct 92. Accordingly, ozone (and a slight amount of toner) sucked through the ozone suction duct 90 is filtered by the filter F4, and clean air is discharged to the outside of the apparatus by the ventilation fan 93.

In such a configuration, toner scattering to the downstream side in the rotational direction of the developing member 43 is sucked through the toner suction duct 80 as indicated by an arrow al in FIG. 12, and ozone which is about to stagnate at the upstream side in the rotational direction of the developing member 43 is sucked through the ozone suction duct 80 as indicated by an arrow a2 in FIG. 12.

Accordingly, the stagnancy of ozone at the upstream side in the rotational direction of the developing member 43 can be prevented and thus the image deterioration can be also prevented, even in a case where images of only a single color (for example, monochromatic images) are sequentially formed, or only a developing member of a single color (for example, the developer cartridge 42K) is loaded to the rotary developing device 40 to construct a single color developing device, or the switching operation of the developing member 43 for the image supporter 21 is not carried out during the image forming operation.

When a color image is formed, in the developing process during which the developing member 43 is kept to be in contact with or in close proximity to the image supporter 21, like the above case, toner scattering to the downstream side in the rotational direction is sucked through the toner suction duct 80 as indicated by the arrow al in FIG. 12, and ozone which is about to stagnate at the upstream side in the rotational direction of the developing member 43 is sucked through the ozone suction duct 90 as indicated by the arrow a2 in FIG. 12.

Figure 18:
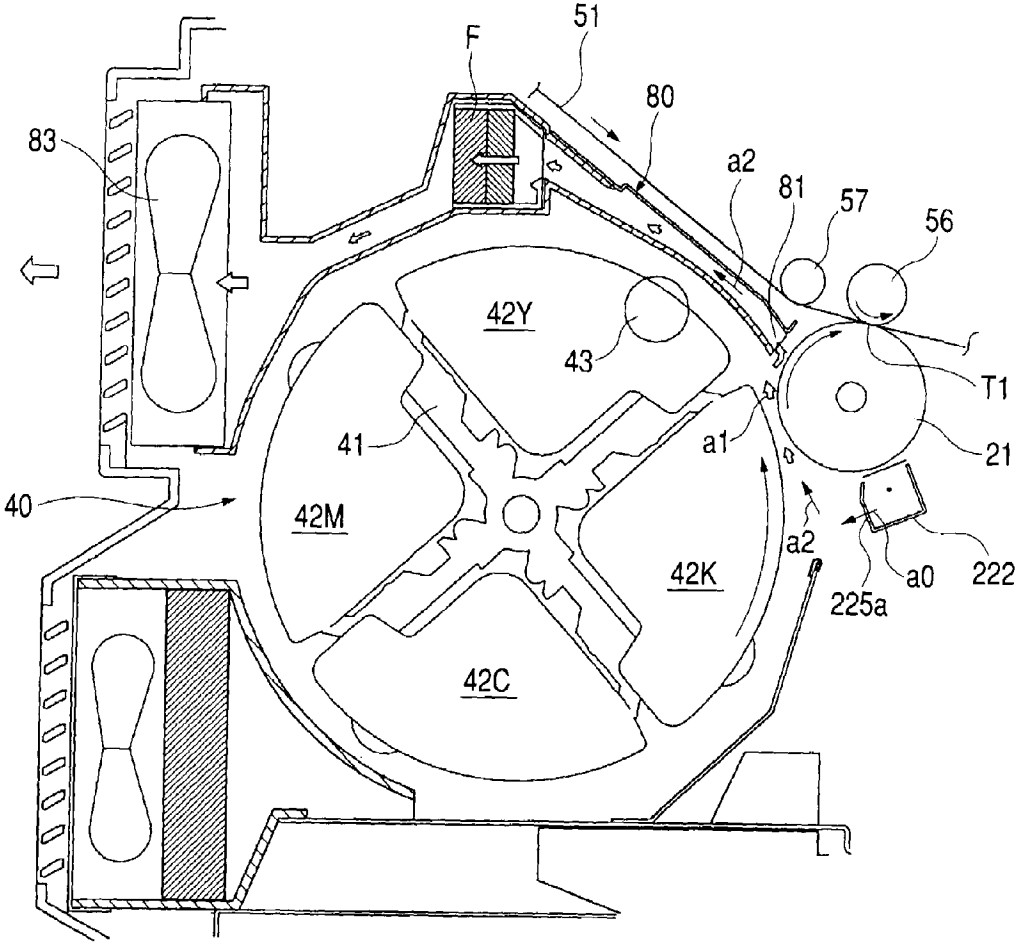
FIG. 18 is an enlarged view showing the essential part of FIG. 11 during the operation for switching the developer cartridge to be used.
Figure 19:
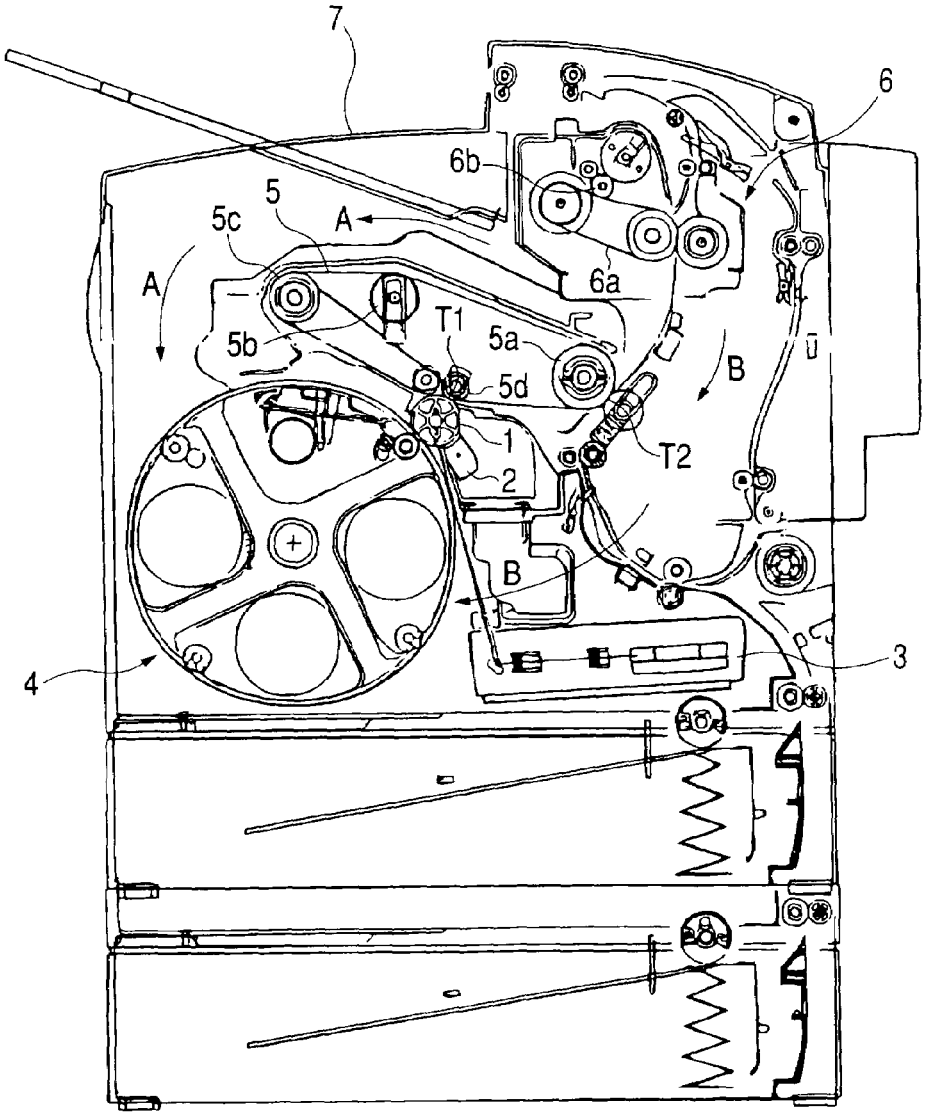
FIG. 19 is a schematic front view showing the internal construction of a related-art image forming apparatus.

However, in the switching operation of the developing member 43, the rotator 41 rotates and the developing member 43 is separated from the image supporter 21, so that a relatively large gap C is formed between the developing member 43 and the image supporter 21 as shown in FIG. 18. Therefore, ozone is also sucked through the toner suction duct 80 as indicated by the arrow a2.

Since the toner suction duct 80 is formed in the substantially semi-cylindrical shape along the circumference of the rotary developing device 40 at the downstream side of the developing portion D for the image supporter 21, an excellent duct can be formed by using a space around the circumference of the rotary developing device 40. Accordingly, the apparatus can be downsized.

Since the ozone suction duct 90 is formed in the substantially semi-cylindrical shape along the circumference of the rotary developing device 40 at the upstream side of the developing portion D for the image supporter 21, an excellent duct can be formed by using a space around the circumference of the rotary developing device 40. Accordingly, the apparatus can be downsized.

Particularly, since the toner suction duct 80 and the ozone suction duct 90 are formed by using the space around the circumference of the rotary developing device 40 substantially half and half, the apparatus can be further downsized.

Since a part of the ozone suction duct 90 is constructed by the frame 211 of the image forming apparatus, a long duct member is not required to form the duct 90 (only a short duct is sufficient), and not only the fabrication performance of the apparatus can be enhanced, but also the apparatus can be further downsized.

In this embodiment, a part of the ozone suction duct 90 is constructed by the frame 211 of the image forming apparatus, and the same construction may be applied to the toner suction duct 80.

The toner suction duct 80 and the duct 92 may be designed to be joined at the terminal portions thereof to equip a single ventilation fan thereat. However, according to this embodiment, the first ventilation fan 83 is equipped at the vent portion of the toner suction duct 80 while the second ventilation fan 93 is equipped at the vent portion of the ozone suction duct 90. Incidentally, the displacement volume of the second ventilation fan 93 is set to be smaller than the displacement volume of the first ventilation fan 83. For example, the second ventilation fan 93 is constructed by a more compact fan as compared with the first ventilation fan 83.

In such a configuration, the toner suction force caused by the toner suction duct 80 and the ozone suction force caused by the ozone suction duct 90 can be properly and easily set in an independent manner.

Since the displacement volume of the second ventilation fan 93 is set to be smaller than the displacement volume of the first ventilation fan 83, no great turbulence occurs in the air flow directing to the toner suction duct 80 when the developing member is switched (see FIG. 18), so that the scattering toner can be excellently sucked.

In this embodiment, air sending ports 225*a* for discharging ozone are formed in a wall face of the corona charger 222, which faces the developing member 43 (see FIG. 14), and the toner suction port 81 is equipped at the opposite side to the air sending ports 225*a* with respect to the developing portion D.

Since the air sending ports 225*a* is equipped to the wall face of the corona charger 222 which faces the developing member 43 side, and the ozone suction duct 90 is equipped at the same side as the air sending ports 225*a* with respect to the developing portion D, ozone generated in the corona charger 222 and discharged from the air sending ports 225*a* to the outside of the charger 222 is efficiently sucked through the ozone suction duct 90 in the developing process.

In the developing color switching operation of the rotary developing device 40, ozone is efficiently sucked through the gap C by the toner suction duct 80 as shown in FIG. 18, and also even when toner scatters in the developing color switching operation, the toner is efficiently sucked from the toner suction port 81.

Therefore, ozone generated in the corona charger 222 and scattering toner can be excellently sucked in both the developing process and the developing color switching operation.

Accordingly, the image deterioration due to ozone can be prevented, and at the same time the pollution of the inside of the apparatus due to toner scattering can be prevented.

With respect to the developing portion D, the air sending ports 225*a* is located at the upstream side (in this embodiment, at the lower side) in the rotational direction (clockwise direction) of the image supporter 21, and the toner suction port 81 is located at the downstream side (in this embodiment, at the upper side) in the rotational direction of the image supporter 21.

Misty toner occurring in the developing process or in the developing color switching operation is liable to be scattered by air flow which is generated by the rotation of the image supporter 21 and directs to the downward side in the rotational direction thereof.

However, since the toner suction port 81 is equipped at the downstream side in the rotational direction of the image supporter 21 with respect to the developing portion D, so that toner can be efficiently sucked from the toner suction port 81 without unnecessarily scattering the toner by the air flow which is generated by the rotation of the image supporter 21 and directs to the downward direction in the rotational direction thereof.

Each developing member 43 comprises a developing roller, and with respect to the developing portion D based on the developing roller 43, the air sending ports 225*a* is located at the upstream side (in this embodiment, at the lower side) in the rotational direction (counterclockwise direction) of the developing roller 43 while the toner suction port 81 is located at the downstream side (in this embodiment, at the upper side) in the rotational direction of the developing roller 43.

In such a case, misty toner occurring in the developing process or in the developing color switching operation is scattered by air flow which is generated by the rotation of the developing roller 43 and directs to the downstream side in the rotational direction thereof.

However, since the toner suction port 81 is located at the downstream side in the rotational direction of the developing roller 43 in connection with the developing portion D, toner can be efficiently sucked from the toner suction port 81 without unnecessarily scattering the toner by the air flow which is generated by the rotation of the developing roller 43 and directs to the downward direction in the rotational direction thereof.

With respect to the developing portion D, the air sending ports 225*a* is located at the upstream side (in this embodiment, at the lower side) in the rotational direction (counterclockwise direction) of the rotator body 41 of the rotary developing device 40, and the toner suction port 81 is located at the downstream side (in this embodiment, at the upper side) in the rotational direction of the rotator body 41.

When the developing member 43 is constructed by the developing roller, misty toner occurring in the developing process or in the developing color switching operation is scattered by air flow which is generated by the rotation of the rotator body 41 and directs to the downstream side in the rotational direction thereof.

However, according to the above configuration, upon the developing color switching operation (see FIG. 18), the air flow directing from the air sending ports 225*a* through the gap C to the toner suction port 81 and the air flow which is generated by the rotation of the rotator body 41 and directs to the downstream side in the rotational direction have the same flowing direction.

Accordingly, toner and ozone can be efficiently sucked from the toner suction port 81 while the scattering (diffusion) of the toner can be reduced without unnecessarily scattering the toner. If the directions of both the air streams are opposite to each other, the toner may be unnecessarily scattered.

Air flow through the toner suction duct 80 and the ozone suction duct 90 is formed by actuation of the ventilation fans 83, 93 described above. In this embodiment, an air blowing unit 270 is provided to further promote the air flow.

Figure 14:
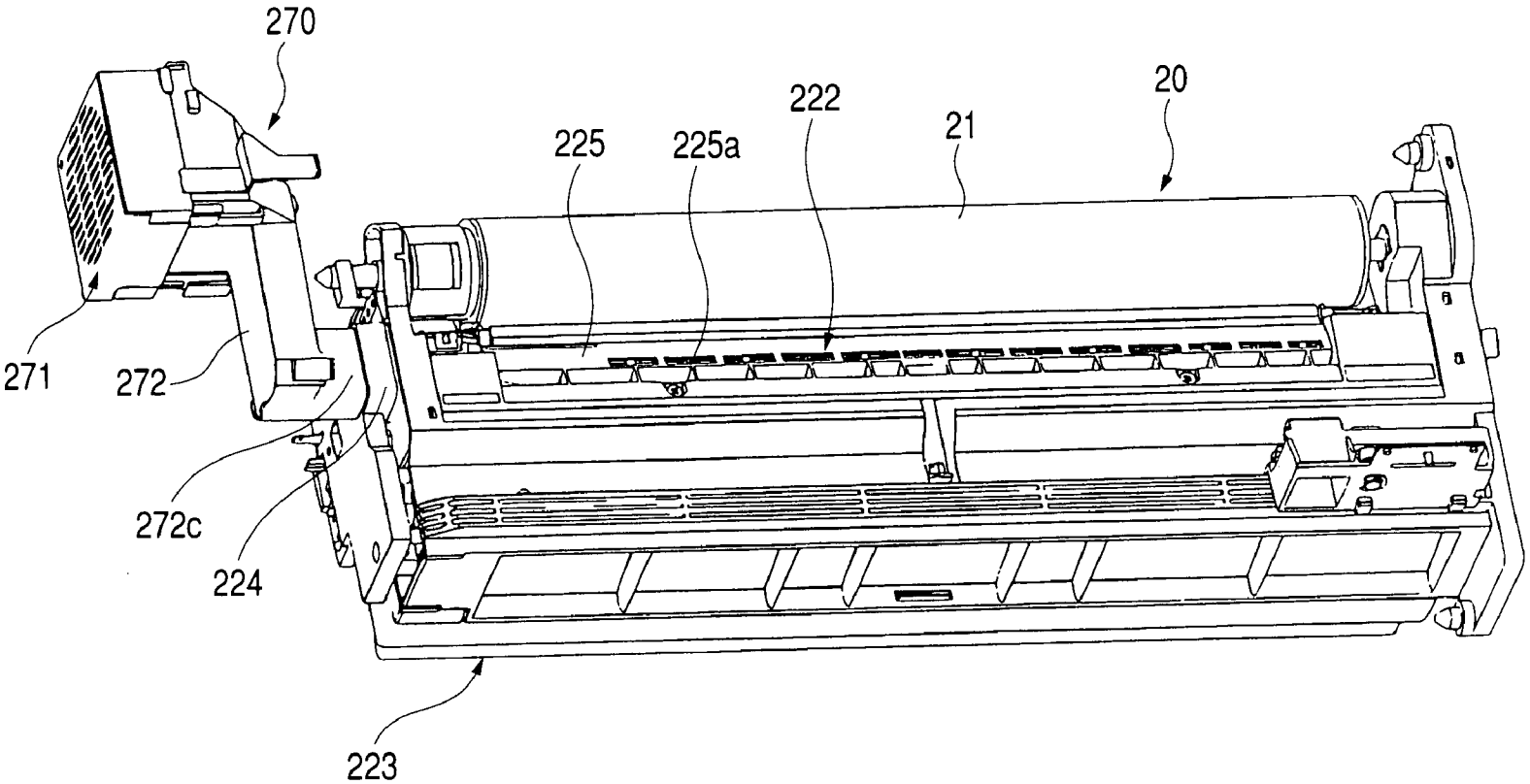
FIG. 14 is a perspective view showing an image supporting device and an air blowing unit in the image forming apparatus of the fourth embodiment.
Figure 15:
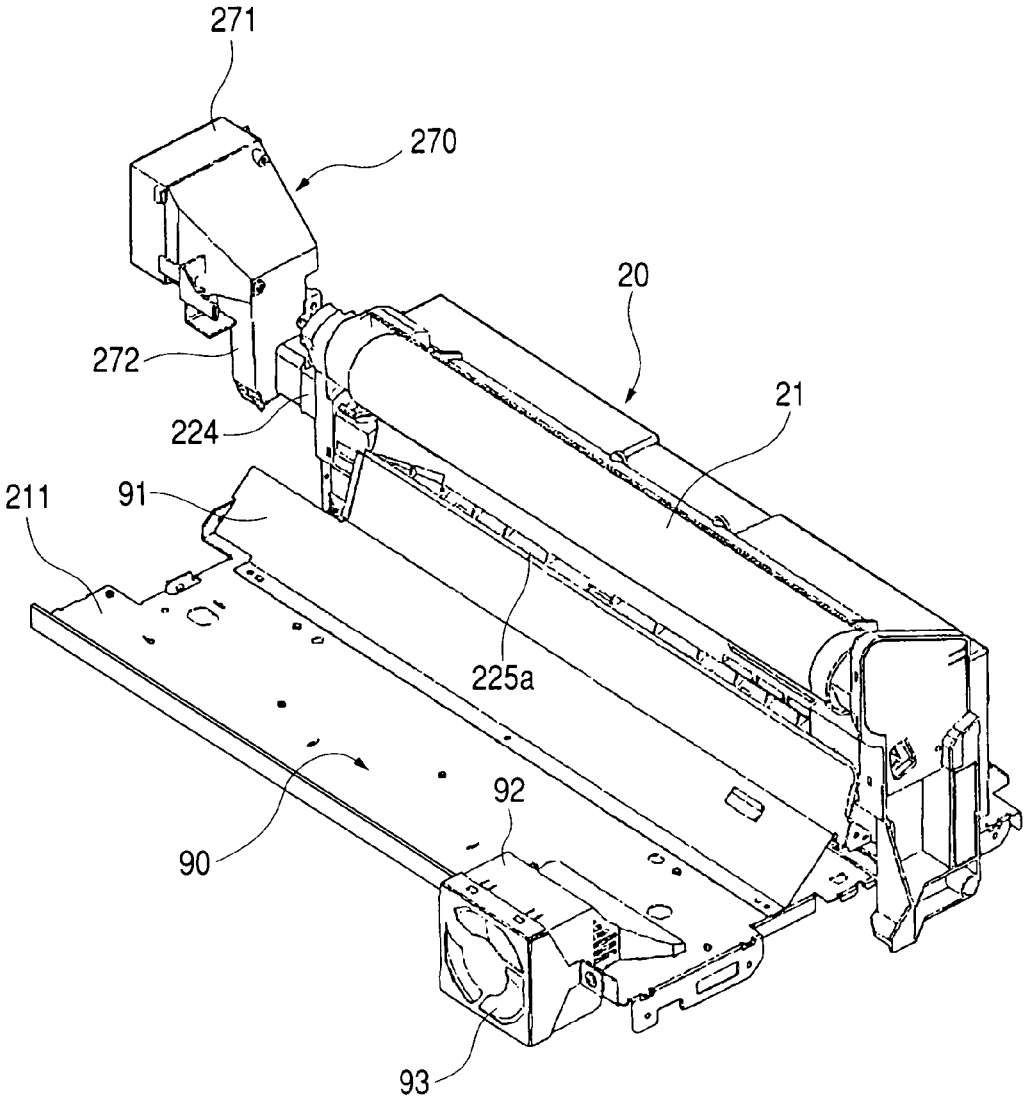
FIG. 15 is a perspective view showing the air blowing unit and an ozone suction duct in the image forming apparatus of the fourth embodiment.

As shown in FIGS. 14 and 15, the air blowing unit 270 is equipped with an air blowing fan 271 (see also FIG. 17) and an air blowing duct 272, and an air blowing port 272*c* of the air blowing duct 272 is joined to a joint port 224 formed in a casing 223 of the image supporting device 20. The joint port 224 is opened to face a longitudinal end of the corona charger 222. As shown in FIG. 14, many air sending ports 225*a* are formed at the developing portion D side (at the side of the developing member 43) of a shield plate 225 of the corona charger 222.

Accordingly, when the air blowing fan 271 is actuated, air is passed from the air blowing fan 271 through the duct 272 and the joint port 224 and blown into the longitudinal end of the corona charger 222, and further air is blown out from the air sending ports 225*a* of the shield plate 225 to the developing portion D side as indicated by an arrow a0 as shown in FIG. 12.

Figure 16:
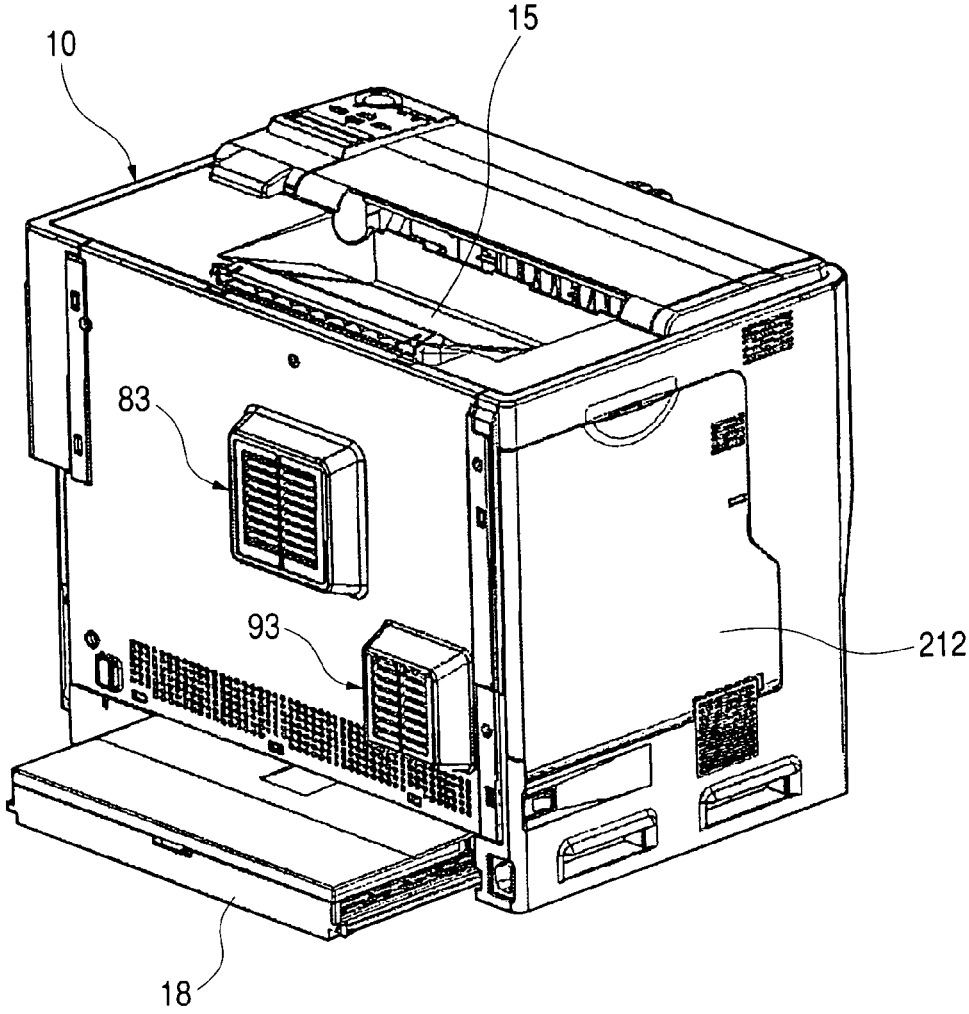
FIG. 16 is a perspective view of the image forming apparatus of the fourth embodiment, which is viewed from the front side.
Figure 17:
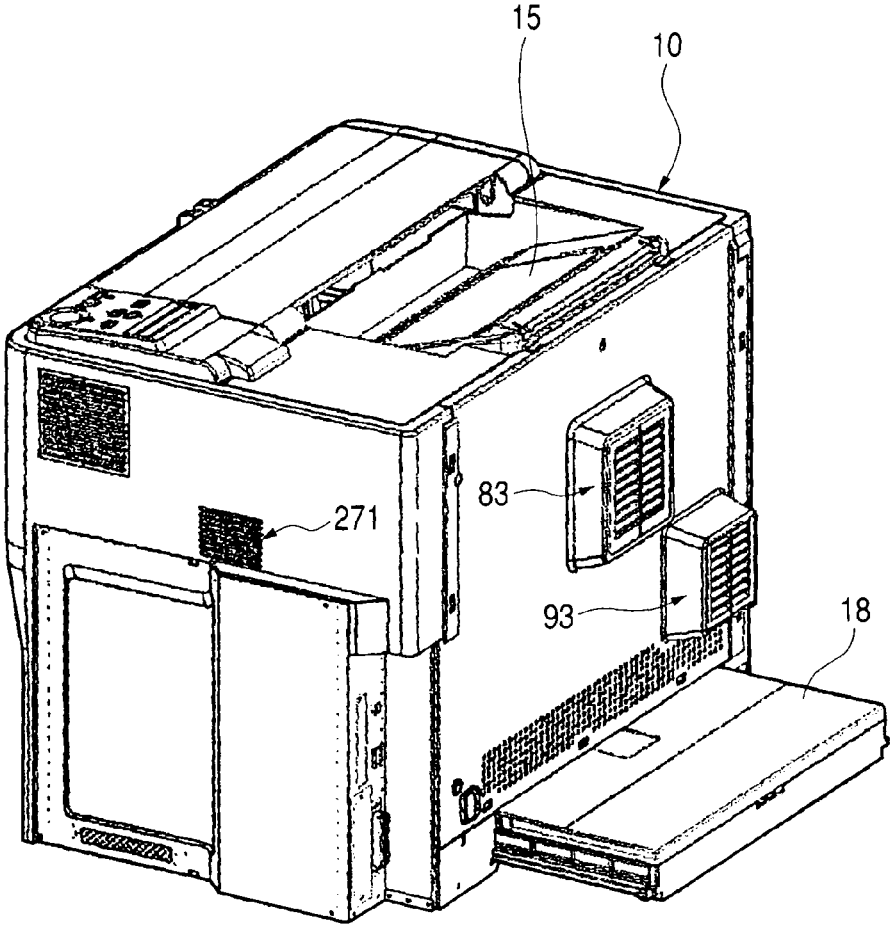
FIG. 17 is a perspective view of the image forming apparatus of the fourth embodiment, which is taken from the back side.

A cover 212 shown in FIG. 16 is opened/closed when the image supporting device 20, the developer cartridges 42, the filter unit F, etc. are detached or attached.

The embodiments of the present invention have been described. However, the present invention is not limited to these embodiments and these embodiments may be suitably modified without departing from the subject matter of the present invention.

What is claimed is:

1. An image forming apparatus, comprising:

an image supporter;

at least one developing device, which applies toner onto a latent image formed on the image supporter to form a toner image thereon;

a plurality of roller members;

a belt member, stretched and circulated by the roller members, on which the toner image, which is to be secondarily transferred onto a recording medium, is primarily transferred;

a fixing device, which heats the recording medium to fix the secondary transferred toner image thereon;

a casing, which accommodates the image supporter, the developing device, the roller members, the belt member and the fixing device, such that the developing device and the fixing device are partitioned by the belt member, and such that one of the roller members is located at a corner portion of the casing;

an exposing device, which selectively irradiates the image supporter to form the latent image thereon, the exposing device is located in the vicinity of the belt member; and a cooler, which cools the exposing device, wherein the developing device and the fixing device are partitioned by the belt member and the exposing device.

2. The image forming apparatus as set forth in claim 1, wherein the fixing device is provided as an oil-less fixing device.

3. The image forming apparatus as set forth in claim 1, further comprising:

a cover member, which is opened or closed at least when a consumable member including at least one of the image supporter and the developing device is replaced;

an optical sensor, which detects a density of the toner image formed on either the image supporter or the belt member, the optical sensor comprising a light emitting window and a light receiving window; and a cleaner, which slides on at least one of the light emitting window and the light receiving window interlockingly with an opening/closing movement of the cover member.

4. The image forming apparatus as set forth in claim 3, wherein at least one of the light emitting window and the light receiving window is covered with the cleaner when the cover member is opened.

5. An image forming apparatus, comprising:

an image supporter;

at least one developing device, which applies toner onto a latent image formed on the image supporter to form a toner image thereon;

a plurality of roller members;

a belt member, stretched and circulated by the roller members, on which the toner image, which is to be secondarily transferred onto a recording medium, is primarily transferred;

a fixing device, which heats the recording medium to fix the secondary transferred toner image thereon;

a casing, which accommodates the image supporter, the developing device, the roller members, the belt member and the fixing device, such that the developing device and the fixing device are partitioned by the belt member, and such that one of the roller members is located at a corner portion of the casing;

a charger, which charges the image supporter;

a first duct, which mainly sucks scattered toner; and a second duct, which mainly sucks ozone generated from the charger, wherein:

the developing device comprises a developing roller forming a developing portion at which the toner is applied to the image supporter;

the first duct is located in a downstream side of the developing portion in connection with a rotational direction of the developing roller; and the second duct is located in an upstream side of the developing portion in connection with the rotational direction of the developing roller.

6. The image forming apparatus as set forth in claim 5, further comprising a cylindrical rotator, which accompanies the at least one developing device at an outer periphery thereof, wherein the first duct has a semi-cylindrical shape so as to extend along the outer periphery of the cylindrical rotator.

7. The image forming apparatus as set forth in claim 5, further comprising a cylindrical rotator, which accompanies the at least one developing device at an outer periphery thereof, wherein the second duct has a semi-cylindrical shape so as to extend along the outer periphery of the cylindrical rotator.

8. The image forming apparatus as set forth in claim 5, wherein at least one of the first duct and the second duct is formed by a part of a frame body of the image forming apparatus.

9. The image forming apparatus as set forth in claim 5, wherein the first duct comprises a first ventilation fan, and the second duct comprises a second ventilation fan.

10. The image forming apparatus as set forth in claim 9, wherein a displacement volume of the second ventilation fan is smaller than a displacement volume of the first ventilation fan.

11. An image forming apparatus, comprising:

an image supporter;

at least one developing device, which applies toner onto a latent image formed on the image supporter to form a toner image thereon;

an optical sensor, which detects a density of the toner image formed on either the image supporter or the belt member, the optical sensor comprising a light emitting window and a light receiving window;

a casing, which accommodates the image supporter, the developing device, the optical sensor, the casing comprises a cover member, which is opened or closed at least when a consumable member including at least one of the image supporter and the developing device is replaced; and a cleaner, which slides on at least one of the light emitting window and the light receiving window interlockingly with an opening/closing movement of the cover member.

12. The image forming apparatus as set forth in claim 11, wherein at least one of the light emitting window and the light receiving window is covered with the cleaner when the cover member is opened.

13. The image forming apparatus as set forth in claim 1, wherein the belt member is slanted with respect to a side of the casing.

14. The image forming apparatus as set forth in claim 1, wherein the roller member positioned at the corner portion of the casing is located at a position higher than other roller members.

15. The image forming apparatus as set forth in claim 1, wherein the roller member positioned at the corner portion of the casing is confronted by a cleaning device that is used to remove toner from the belt member.

16. The image forming apparatus as set forth in claim 15, wherein a gap between an inner face of the casing and the roller member positioned at the corner portion of the casing is closed by the cleaning device.

17. The image forming apparatus as set forth in claim 5, wherein the fixing device is provided as an oil-less fixing device.

18. The image forming apparatus as set forth in claim 5, further comprising:

a cover member, which is opened or closed at least when a consumable member including at least one of the image supporter and the developing device is replaced;

an optical sensor, which detects a density of the toner image formed on either the image supporter or the belt member, the optical sensor comprising a light emitting window and a light receiving window; and a cleaner, which slides on at least one of the light emitting window and the light receiving window interlockingly with an opening/closing movement of the cover member.

19. The image forming apparatus as set forth in claim 18, wherein at least one of the light emitting window and the light receiving window is covered with the cleaner when the cover member is opened.

20. The image forming apparatus as set forth in claim 5, wherein the belt member is slanted with respect to a side of the casing.

21. The image forming apparatus as set forth in claim 5, wherein the roller member positioned at the corner portion of the casing is located at a position higher than other roller members.

22. The image forming apparatus as set forth in claim 5, wherein the roller member positioned at the corner portion of the casing is confronted by a cleaning device that is used to remove toner from the belt member.

23. The image forming apparatus as set forth in claim 22, wherein a gap between an inner face of the casing and the roller member positioned at the corner portion of the casing is closed by the cleaning device.

* * * * *